US009847053B2

(12) United States Patent
Hu et al.

(10) Patent No.: US 9,847,053 B2
(45) Date of Patent: Dec. 19, 2017

(54) DISPLAY APPARATUS, GATE DRIVER AND OPERATION METHOD THEREOF

(71) Applicant: Novatek Microelectronics Corp., Hsinchu (TW)

(72) Inventors: Jen-Chieh Hu, Hsinchu County (TW); Jung-Chieh Cheng, Changhua County (TW)

(73) Assignee: Novatek Microelectronics Corp., Hsinchu (TW)

( * ) Notice: Subject to any disclaimer, the term of this patent is extended or adjusted under 35 U.S.C. 154(b) by 196 days.

(21) Appl. No.: 15/016,294

(22) Filed: Feb. 5, 2016

(65) Prior Publication Data

US 2017/0229055 A1 Aug. 10, 2017

(51) Int. Cl.
*G09G 3/20* (2006.01)

(52) U.S. Cl.
CPC ... *G09G 3/2092* (2013.01); *G09G 2310/0291* (2013.01); *G09G 2310/063* (2013.01); *G09G 2310/08* (2013.01); *G09G 2320/0693* (2013.01)

(58) Field of Classification Search
CPC ..... G09G 3/2092; G09G 2320/0693; G09G 2310/08; G09G 2310/0291; G09G 2310/063
See application file for complete search history.

(56) References Cited

U.S. PATENT DOCUMENTS 6,738,037 B1 * 5/2004 Akimoto ..... G09G 3/3688 345/96
8,169,426 B2 * 5/2012 Govil ..... B81C 99/003 345/204
8,917,266 B2 12/2014 Park et al.
2004/0263449 A1 12/2004 Baek et al.
2008/0170052 A1 * 7/2008 Ryu ..... G06F 3/14 345/204
2012/0299974 A1 11/2012 Park et al.
2013/0093748 A1 4/2013 Cho
2013/0141403 A1 * 6/2013 Shibuya ..... H03K 5/15 345/204
2015/0028933 A1 1/2015 Chen
(Continued)

FOREIGN PATENT DOCUMENTS

CN 102610206 7/2012
CN 102622983 8/2012
(Continued)

OTHER PUBLICATIONS

"Office Action of Taiwan Counterpart Application", dated Oct. 5, 2016, p. 1-p. 3, in which the listed references were cited.

*Primary Examiner* — Andrew Sasinowski
(74) *Attorney, Agent, or Firm* — JCIPRNET

(57) ABSTRACT

A display apparatus, a gate driver and an operation method thereof are provided. The gate driver includes a first input buffer and a gate line driving circuit. An input terminal of the first input buffer is configured to receive a timing control signal from the outside of the gate driver. The gate line driving circuit is coupled to an output terminal of the first input buffer. The gate line driving circuit is configured to scan a plurality of gate lines of the display panel based on the control of the timing control signal. An output impedance of the first input buffer is correspondingly adjusted according to the coupling noise of the gate driver.

20 Claims, 15 Drawing Sheets

(56) References Cited

U.S. PATENT DOCUMENTS

| | | | | |
|---|---|---|---|---|
| 2015/0123886 | A1 | 5/2015 | Chen | |
| 2015/0243239 | A1* | 8/2015 | Uemura | G09G 3/3614 345/209 |
| 2017/0249882 | A1* | 8/2017 | Lee | G09G 3/006 |

FOREIGN PATENT DOCUMENTS

| | | |
|---|---|---|
| TW | 201248603 | 12/2012 |
| TW | I444733 | 7/2014 |
| TW | I457896 | 10/2014 |

* cited by examiner

DISPLAY APPARATUS, GATE DRIVER AND OPERATION METHOD THEREOF

BACKGROUND

Field of the Invention

The invention is directed to a display apparatus and more particularly, to a display apparatus, a gate driver and an operation method thereof.

Description of Related Art

FIG. 1 is a schematic diagram illustrating an equivalent circuit of a display panel in the related art. A display panel 110 has a plurality of source lines 111, a plurality of gate lines 112 and a plurality of pixel circuits 113. The source lines 111 are perpendicular to the gate lines 112. The pixel circuits 113 are distributed in an array on the display panel 110. Source terminals of the pixel circuits 113 are respectively coupled to the corresponding source lines 111, and gate terminals of the pixel circuits 113 are respectively coupled to the corresponding gate lines 112, as illustrated in FIG. 1.

A plurality of output terminals of a gate driver 120 are one-to-one coupled to different gate lines 112. The gate driver 120 may takes turn to drive (or scan) each of the gate lines 112 of the display panel 110 one by one. A source driver 130 converts a plurality of digital pixel data into corresponding driving voltages (pixel voltages). Based on a scanning sequence of the gate driver 120, the source driver 130 write the corresponding pixel voltages into the corresponding pixel circuits 113 of the display panel 110 through the source lines 111.

A plurality of parasitic capacitors 114 exist between the source lines 111 and the gate lines 112. In the process of the source driver 130 writing the driving voltages (pixel voltages) into the pixel circuits 113 through the source lines 111, AC components of the driving voltages of the source lines 111 are transmitted to the gate lines 112 through the parasitic capacitors 114. AC components of the driving voltages of the source lines 111 are transmitted to the gate driver 120 through the gate lines 112, and generate coupling noise of the gate driver 120. The coupling noise influences different internal signals in the gate driver 120 through a substrate or a body of the gate driver 120, and may even influence a ground voltage inside the gate driver 120.

FIG. 2 is a schematic waveform diagram of the source lines 111 and the gate lines 112 depicted in FIG. 1. In FIG. 2, the horizontal axis represents the time, and VCOM represents a common voltage of the display panel 110. When the source driver 130 outputs a specific image (in a specific pattern) to the source lines 111 of the display panel 110, the voltages of several (even all of) the source lines 111 may simultaneously rise up or drop down, such that the coupling noise (as illustrated in FIG. 2) occurs in the signals of the gate lines 112. The coupling noise enters the gate driver 120 through the gate lines 112.

SUMMARY

The invention provides a display apparatus, a gate driver and an operation method thereof, by which an output impedance may be correspondingly adjusted according to a coupling noise of the gate driver to avoid malfunction caused by the coupling noise.

According to an embodiment of the invention, a gate driver of a display panel is provided. The gate driver includes a sensing circuit, a first input buffer and a gate line driving circuit. The sensing circuit is configured to sense a coupling noise of the gate driver. An input terminal of the first input buffer is configured to receive a timing control signal from the outside of the gate driver, wherein an output impedance of an output terminal of the first input buffer is correspondingly adjusted according to the coupling noise of the gate driver. The gate line driving circuit is coupled to the output terminal of the first input buffer. The gate line driving circuit is configured to scan a plurality of gate lines of the display panel based on the control of the timing control signal.

According to an embodiment of the invention, an operation method of a gate driver of a display panel is provided. The gate driver has a first input buffer. The operation method includes: sensing a coupling noise of the gate driver; receiving a timing control signal from the outside of the gate driver; scanning a plurality of gate lines of the display panel based on the control of the timing control signal; and correspondingly adjusting an output impedance of the first input buffer according to the coupling noise of the gate driver.

According to an embodiment of the invention, an operation method of a display apparatus is provided. The display apparatus having a timing controller and a gate driver. The operation method includes: outputting a timing control signal by the timing controller; receiving the timing control signal and scanning a plurality of gate lines of a display panel based on the control of the timing control signal by the gate driver; sensing a coupling noise of the gate driver; returning a noise detection signal corresponding to the coupling noise of the gate driver to the timing controller by the gate driver; and correspondingly adjusting the output impedance of the output terminal of the timing controller according to the noise detection signal.

To sum up, the display apparatus, the gate driver and the operation method thereof can be utilized to detect the coupling noise of the gate driver. In some embodiments, the output impedance of the input buffer of the gate driver can be correspondingly adjusted according to the coupling noise. In some other embodiments, the output impedance of the output terminal of the timing controller can be correspondingly adjusted according to the coupling noise of the gate driver. Thus, the invention can contribute to avoiding malfunction caused by the coupling noise.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
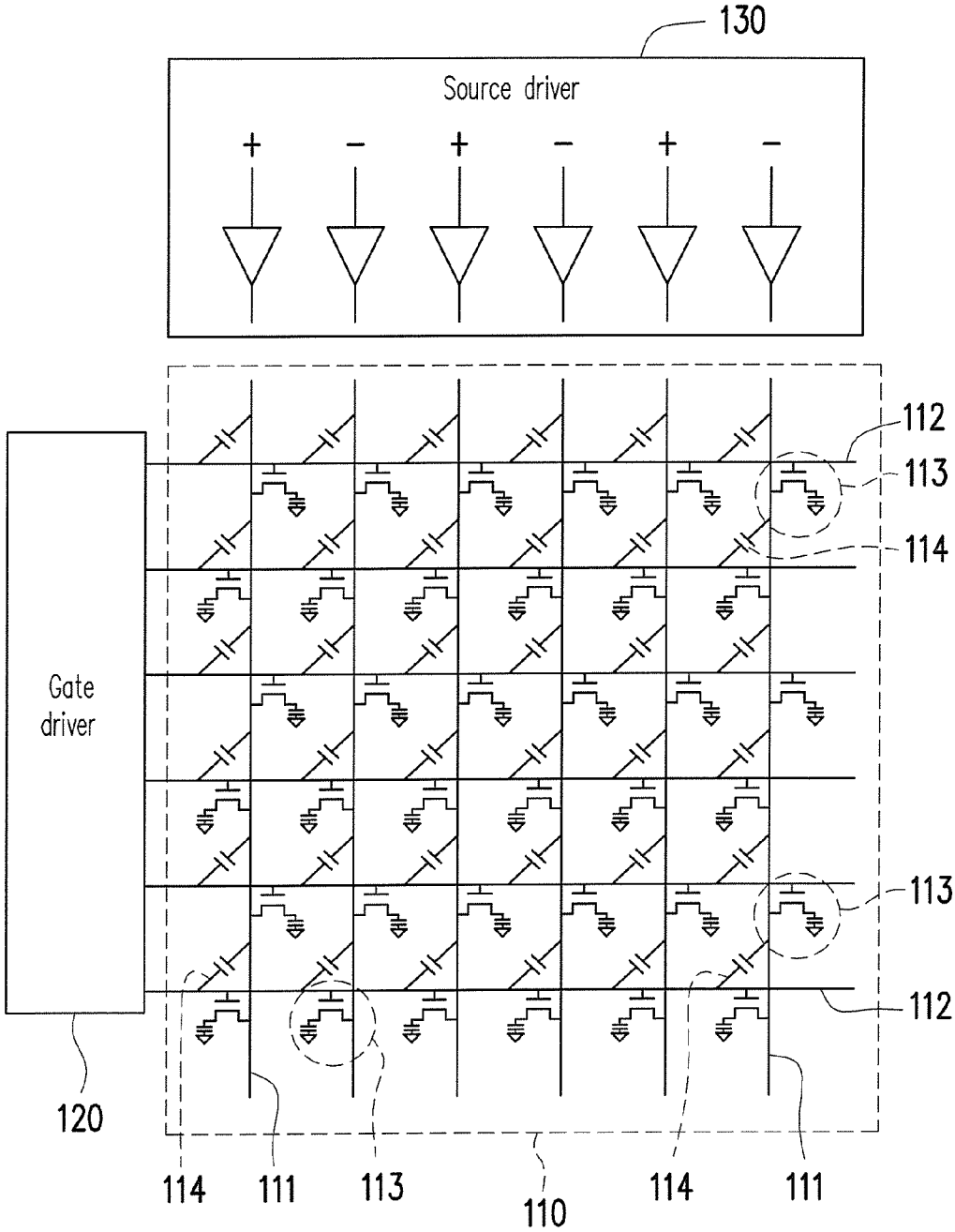
FIG. 1 (RELATED ART)
FIG. 1 is a schematic diagram illustrating an equivalent circuit of a display panel in the related art.
Figure 2:
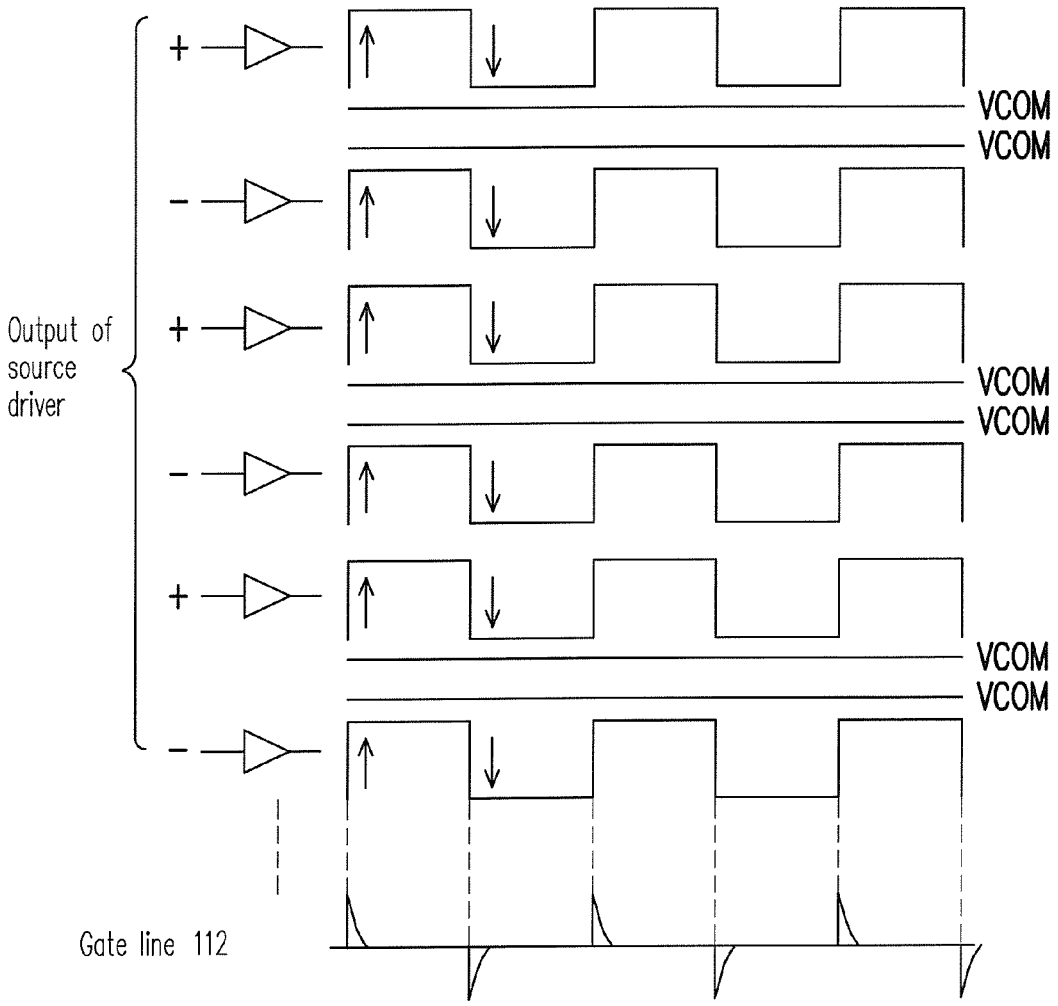
FIG. 2 (RELATED ART)
FIG. 2 is a schematic waveform diagram of the source lines 111 and the gate lines 112 depicted in FIG. 1.

A term "couple" used in the full text of the disclosure (including the claims) refers to any direct and indirect connections. For instance, if a first device is described to be coupled to a second device, it is interpreted as that the first device is directly coupled to the second device, or the first device is indirectly coupled to the second device through other devices or connection means. Moreover, wherever possible, components/members/steps using the same referential numbers in the drawings and description refer to the same or like parts. Components/members/steps using the same referential numbers or using the same terms in different embodiments may cross-refer related descriptions.

Figure 3:
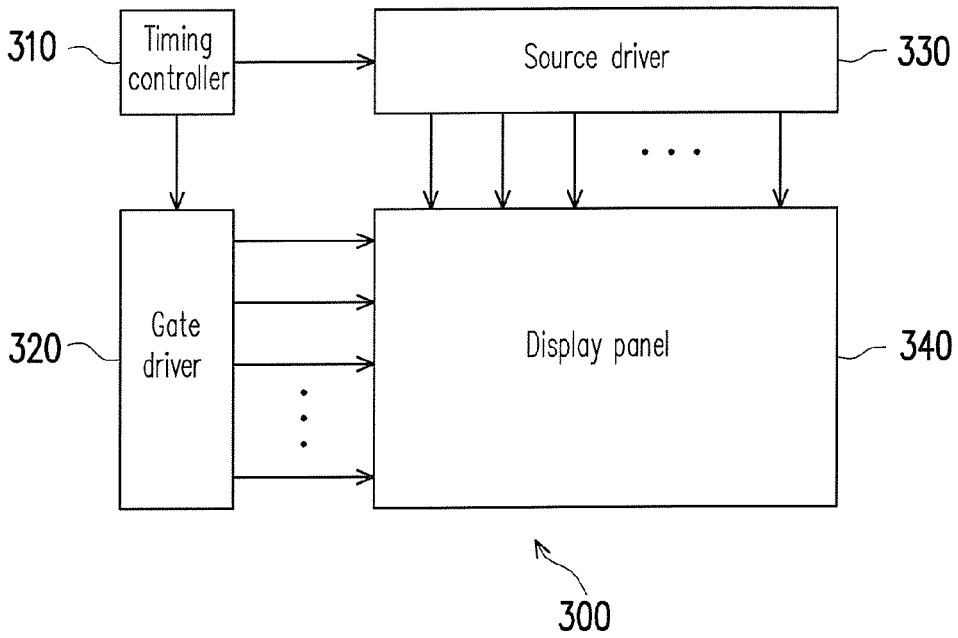
FIG. 3 is a schematic circuit block diagram illustrating a display apparatus according to an embodiment of the invention.

FIG. 3 is a schematic circuit block diagram illustrating a display apparatus 300 according to an embodiment of the invention. The display apparatus 300 illustrated in FIG. 3 includes a timing controller 310, a gate driver 320, a source driver 330 and a display panel 340. The timing controller 310 outputs a timing control signal (e.g., a start pulse signal STV, a gate clock signal GCLK and/or an output enable signal OE) to the gate driver 320. The gate driver 320 is coupled to an output terminal of the timing controller 310 to receive the timing control signal. A plurality of output terminals of the gate driver 320 are one-to-one coupled to different gate lines of the display panel 340. The gate driver 320 scans each gate line of the display panel 340 based on the control of the timing control signal. The timing controller 310 also outputs pixel data and a timing control signal (e.g., a horizontal start pulse signal or a source clock signal) to the source driver 330. The source driver 330 converts digital pixel data into corresponding driving voltages (pixel voltages). Based on a scanning sequence of the gate driver 320, the source driver 330 writes the corresponding pixel voltages into corresponding pixel circuits of the display panel 340 through the source lines to display an image. The display panel 340 may be any type of flat panel display. For example, in some embodiments, the display panel 340 may be deduced according to the description related to the display panel 110 illustrated in FIG. 1.

Figure 4:
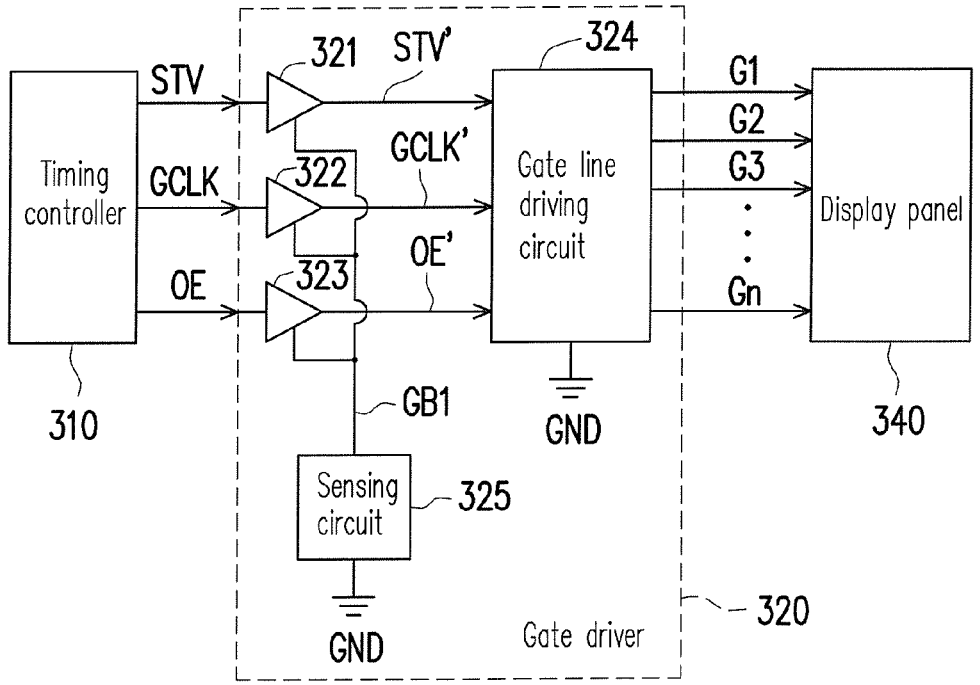
FIG. 4 is a schematic circuit block diagram of the gate driver depicted in FIG. 3 according to an embodiment of the invention.

FIG. 4 is a schematic circuit block diagram of the gate driver 320 depicted in FIG. 3 according to an embodiment of the invention. Referring to FIG. 4, the gate driver 320 includes one or more first input buffers, including first input buffers 321, 322 and 323, as illustrated in FIG. 4. Inputs terminal of the first input buffers 321, 322 and 323 are configured to receive a timing control signals from the outside of the gate driver 320. For example, the input terminal of the first input buffer 321 may receive a start pulse signal STV from the timing controller 310, the input terminal of the first input buffer 322 may receive a gate clock signal GCLK from the timing controller 310, and the input terminal of the first input buffer 323 may receive an output enable signal OE from the timing controller 310. The gate driver 320 further includes a gate line driving circuit 324 and a sensing circuit 325. The gate line driving circuit 324 is coupled to output terminals of the first input buffers 321, 322 and 323. The output terminal of the first input buffer 321 may provide a start pulse signal STV' to the gate line driving circuit 324, the output terminal of the first input buffer 322 may provide a gate clock signal GCLK' to the gate line driving circuit 324, and the output terminal of the first input buffer 323 may provide an output enable signal OE' to the gate line driving circuit 324. Based on the control of the timing control signals (e.g., the start pulse signal STV', the gate clock signal GCLK' and/or the output enable signal OE'), the gate line driving circuit 324 scans a plurality of gate lines (e.g., gate lines G1, G2, G3, . . . , Gn illustrated in FIG. 4) of the display panel 340.

A plurality of parasitic capacitors exist between the source lines and the gate lines of the display panel 340. In the process of the source driver 330 writing the driving voltages (pixel voltages) into the pixel circuits through the source lines of the display panel 340, AC components of the driving voltages of the source lines of the display panel 340 are transmitted to the gate lines of the display panel 340 through the parasitic capacitors. AC components of the driving voltages of the source lines of the display panel 340 are transmitted to the gate driver 320 through the gate lines of the display panel 340 and generate coupling noise of gate driver 320. The coupling noise influences different internal signals (e.g., the start pulse signal STV', the gate clock signal GCLK' and/or the output enable signal OE') in the gate driver 120 through a substrate or a body of the gate driver 320 and may even influence a ground voltage GND inside the gate driver 320.

Figure 5:
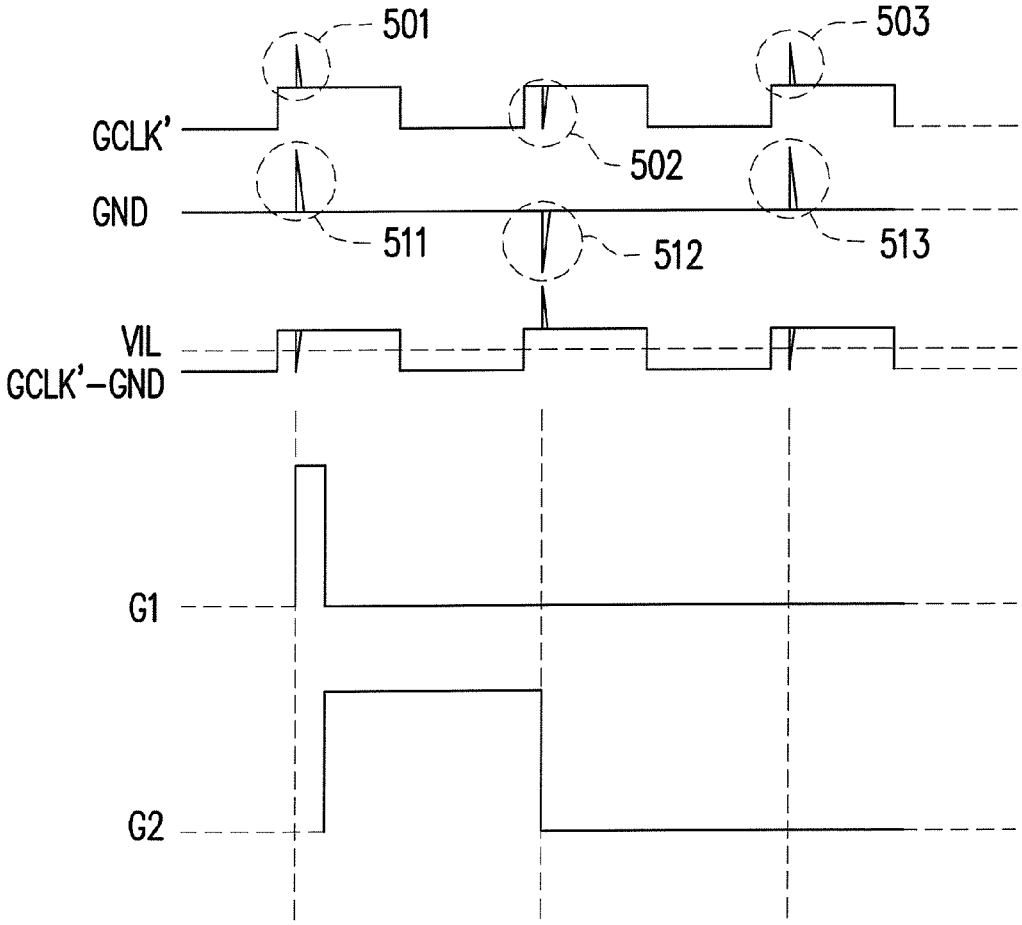
FIG. 5 is a schematic waveform diagram of the gate driver depicted in FIG. 4 according to an embodiment of the invention.

FIG. 5 is a schematic waveform diagram of the gate driver 320 depicted in FIG. 4 according to an embodiment of the invention. Referring to FIG. 4 and FIG. 5, the coupling noise influences different internal signals (e.g., the gate clock signal GCLK') and the ground voltage GND of the gate driver 320 through the substrate or the body of the gate driver 320. The gate clock signal GCLK' illustrated in FIG. 5 has a plurality of positive pulses (e.g., noise 501 and noise 503 illustrated in FIG. 5) and plurality of negative pulses (e.g., noise 502 illustrated in FIG. 5) occur due to the coupling noise. Due to the influence from the same coupling noise, the ground voltage GND also has a plurality of positive pulses (e.g., noise 511 and noise 513 illustrated in FIG. 5) and a plurality of negative pulses (e.g., noise 512 illustrated in FIG. 5). For a circuit/device (e.g., the first input buffer 322), a level of the gate clock signal GCLK' has to be determined with reference to a level of the ground voltage GND, that is, the level of the clock signal is determined according to a voltage difference (i.e., GCLK'-GND) between the gate clock signal GCLK' and the ground voltage GND.

Based on the influence from an output impedance (or a turn-on-resistance (Ron) value of an internal transistor of the first input buffer 322) of the first input buffer 322, an intensity (or an amplitude) of the coupling noise of the timing control signal (e.g., the gate clock signal GCLK') is usually less than an intensity (or an amplitude) of the coupling noise of the ground voltage GND. As the application environment of the gate driver 320 varies (e.g., as different display panels 340 are selected), the intensity (or the amplitude) of the coupling noise also varies. In case the output impedance of the first input buffer 322 is unable to change, once the coupling noise exceeds a specific tolerance range (e.g., referring to FIG. 5, the voltage difference GCLK'-GND between the gate clock signal GCLK' and the ground voltage GND is lower than a threshold VIL), malfunction may occur to the gate line driving circuit 324 due to the coupling noise, so as to output a scan signal with an error phase and/or an error pulse width to the gate lines G1 and G2.

In the gate driver 320 illustrated in FIG. 4, the output impedances of the first input buffers 321, 322 and/or 323 are correspondingly adjusted according to the coupling noise of the gate driver 320. The sensing circuit 325 senses the coupling noise of the gate driver 320 and correspondingly adjusts the output impedances of the first input buffers 321, 322 and/or 323 according to the sensing result. When an noise intensity (or an amplitude) of the voltage difference GCLK'-GND between the gate clock signal GCLK' (i.e., the timing control signal) and the ground voltage GND is lower than the threshold VIL, the sensing circuit 325 provides an output impedance control signal GB1 to the first input buffers 321, 322 and/or 323, so as to increase the output impedances of the first input buffers 321, 322 and/or 323 (namely, to reduce a thrusting/driving capabilities of the first input buffers 321, 322 and/or 323).

Figure 6:
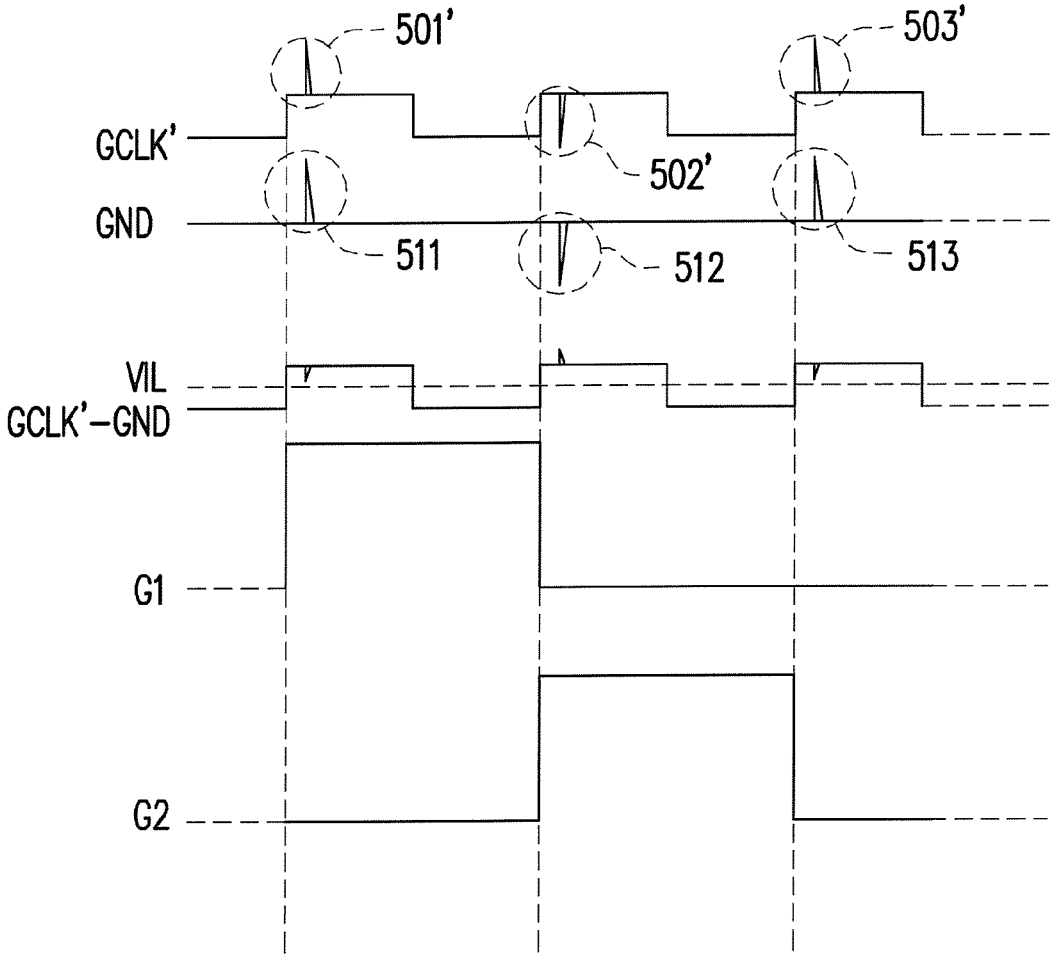
FIG. 6 is a schematic waveform diagram of the gate driver depicted in FIG. 4 according to an embodiment of the invention.

For instance, FIG. 6 is a schematic waveform diagram of the gate driver 320 depicted in FIG. 4 according to an embodiment of the invention. Referring to FIG. 4 and FIG. 6, based on the control of the output impedance control signal GB1 of the sensing circuit 325, when the output impedances of the first input buffers 321, 322 and/or 323 are increased (i.e., the thrusting/driving capabilities are reduced), intensities (or amplitudes) of noise 501', noise 502' and noise 503' are increased in the gate clock signal GCLK' due to the coupling noise. When the intensity (or the amplitude) of the coupling noise of the gate clock signal GCLK' is close (even equal) to the intensity (or the amplitude) of the coupling noise of the ground voltage GND, the noise intensity (or the amplitude) of the voltage difference GCLK'-GND may be reduced. When the intensity (the amplitude) of the coupling noise of the voltage difference GCLK'-GND is within the tolerance range, the coupling noise does not cause malfunction to the gate driver 320. Thus, the gate line driving circuit 324 may output a scan signal with an accurate phase and an accurate pulse width to the gate lines G1 and G2.

The adjusting means/mechanism of the output impedances of the first input buffers 321, 322 and/or 323 is not particularly limited in the present embodiment. In some embodiments, the first input buffers 321, 322 and/or 323 may be implemented by a conventional adjusting means/mechanism, so as to adjust the output impedances of the first input buffers 321, 322 and/or 323 (or to adjust the thrusting/driving capabilities of the first input buffers 321, 322 and/or 323). In some other embodiments, the implementation of the first input buffers 321, 322 and/or 323 may refer to the description related to the embodiment illustrated in FIG. 7.

Figure 7:
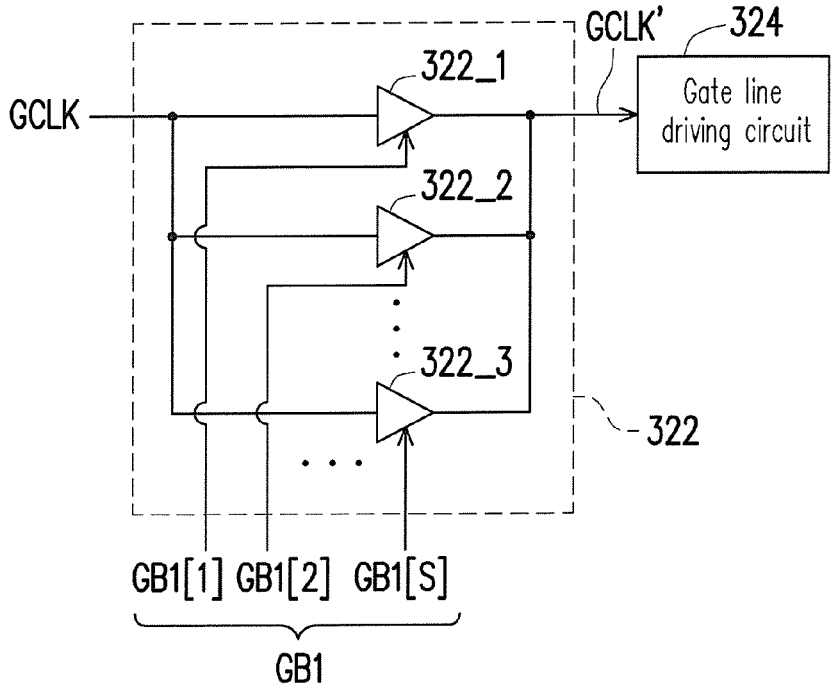
FIG. 7 is a schematic waveform diagram of the first input buffer depicted in FIG. 4 according to an embodiment of the invention.

FIG. 7 is a schematic waveform diagram of the first input buffer 322 depicted in FIG. 4 according to an embodiment of the invention. The other first input buffers 321 and/or 323 illustrated in FIG. 4 may be deduced according to the description related to the first input buffer 322 illustrated in FIG. 7. Referring to FIG. 4 and FIG. 7, the sensing circuit 325 correspondingly provides the output impedance control signal GB1 to the first input buffer 322 to adjust the output impedance of the first input buffer 322 according to the coupling noise. In the embodiment illustrated in FIG. 7, the first input buffer 322 includes buffer circuits 322_1, 322_2, . . . , **322_*s*, where s is an integer greater than or equal to 1. Input terminals of the buffer circuits 322_1 to 322_*s* are coupled to the input terminal of the first input buffer 322 to receive the gate clock signal GCLK. Output terminals of the buffer circuits 322_1 to 322_*s* are coupled to the output terminal of the first input buffer 322 to provide the gate clock signal GCLK' to the gate line driving circuit 324. The buffer circuits 322_1 to 322_*s* may be conventional buffers. In some embodiments, output impedances of output terminals of the buffer circuits 322_1 to 322_*s* may be the same as one another. In some other embodiments, the output impedances of output terminals of the buffer circuits 322_1 to 322_*s* may be different from one another. For example (but not limited to), the output impedance of the output terminal of the buffer circuit 322_2 may be twice (the first power of 2 times) the output impedance of the output terminal of the buffer circuit 322_1, and the output impedance of the output terminal of the buffer circuit 322_*s* may be the (s−1)th power of 2 times the output impedance of the output terminal of the buffer circuit 322_1**.

Enable terminals of the buffer circuits 322_1 to **322_*s* are one-to-one coupled to a plurality of bits GB1[1], GB1[2], . . . , GB1[s] of the output impedance control signal GB1, as illustrated in FIG. 7. When the bit GB1[1] is logic 1, the buffer circuit 322_1 is enabled, and the buffer circuit 322_1 receives the gate clock signal GCLK and transmits the gate clock signal GCLK' to the gate line driving circuit 324. When the bit GB1[1] is logic 0, the buffer circuit 322_1 is disabled, and the output terminal of the buffer circuit 322_1 has a high impedance. The rest of the buffer circuits 322_2 to 322_*s* may be deduced according to the description related to the buffer circuit 322_1 and thus, will not be repeated. The more the enabled buffer circuits, the lower the output impedance of the first input buffer 322**.

Figure 8:
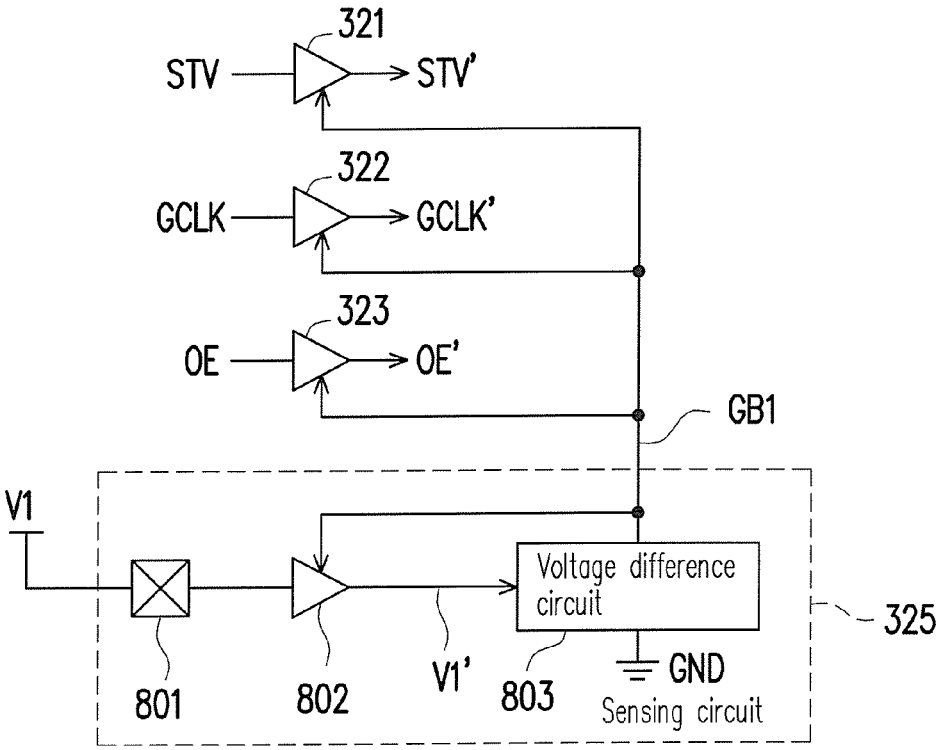
FIG. 8 is a schematic waveform diagram of the sensing circuit depicted in FIG. 4 according to an embodiment of the invention.

FIG. 8 is a schematic waveform diagram of the sensing circuit 352 depicted in FIG. 4 according to an embodiment of the invention. Referring to FIG. 4 and FIG. 8, the sensing circuit 325 correspondingly provides the output impedance control signal GB1 to the first input buffers 321, 322 and/or 323 to adjust the output impedances of the first input buffers 321, 322 and/or 323 according to the coupling noise. The sensing circuit 325 illustrated in FIG. 8 includes a pad 801, a second input buffer 802 and a voltage difference circuit 803. The pad 801 is coupled to the first reference voltage V1. The first reference voltage V1 may be a DC voltage having any fixed level, such as a system voltage. An input terminal of the second input buffer 802 is coupled to the pad 801 to receive the first reference voltage V1. An output terminal of the second input buffer 802 outputs a corresponding voltage V1'. A first input terminal of the voltage difference circuit 803 is coupled to the output terminal of the second input buffer 802 to receive the corresponding voltage V1'. A second input terminal of the voltage difference circuit 803 is coupled to a second reference voltage, e.g., the ground voltage GND. The voltage difference circuit 803 detects the voltage difference (i.e., V1'-GND) between the corresponding voltage V1' and the ground voltage GND (i.e., the second reference voltage). The voltage difference circuit 803 correspondingly determines the output impedance control signal GB1 and provides the output impedance control signal GB1 to a control terminal of the second input buffer 802 according to the voltage difference V1'-GND to adjust the output impedance of the second input buffer 802. The output impedance control signal GB1 is further provided to control terminals of the first input buffers 321, 322 and/or 323 to adjust the output impedances of the first input buffers 321, 322 and/or 323.

Figure 9:
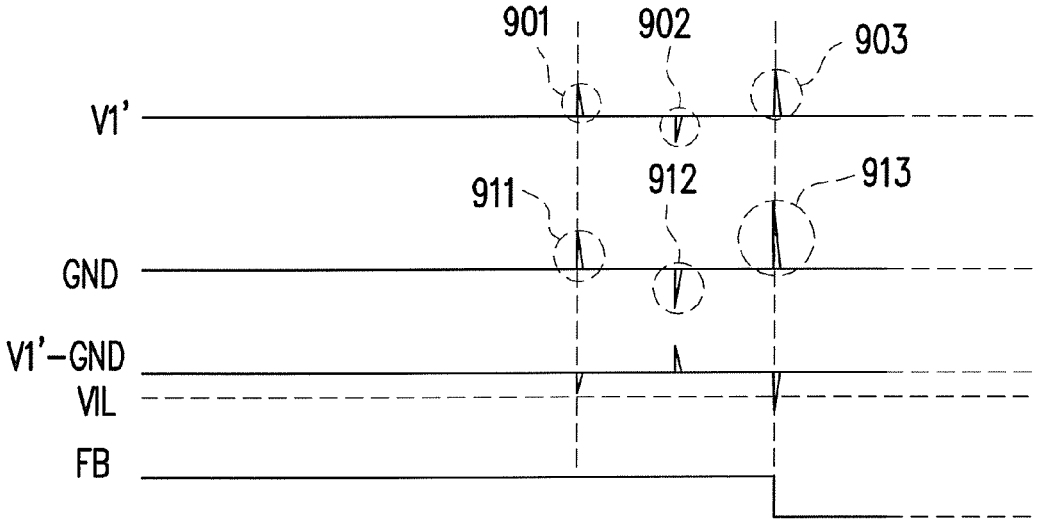
FIG. 9 is a schematic waveform diagram of the circuit depicted in FIG. 8 according to an embodiment of the invention.

FIG. 9 is a schematic waveform diagram of the circuit depicted in FIG. 8 according to an embodiment of the invention. Due to the influence of the output impedance of the second input buffer 802, an intensity (or an amplitude) of coupling noise of the corresponding voltage V1' is usually lower than an intensity (or an amplitude) of coupling noise of the ground voltage GND. The output impedance of the second input buffer 802 is correspondingly adjusted according to the coupling noise of the gate driver 320. It is assumed herein that the coupling noise results in the generation of noise 901, noise 902 and noise 903 of the corresponding voltage V1' and results in the generation of noise 911, noise 912 and noise 913 of the ground voltage GND. When the voltage difference circuit 803 detects that the voltage difference V1'-GND is lower than the threshold VIL, it represents that the coupling noise exceeds a specific tolerance range, and accordingly, the voltage difference circuit 803 determines that the current output impedance of the second input buffer 802 (which are the output impedances of the first input buffers 321, 322 and/or 323) are suitable for the current environment. When the voltage difference V1'-GND is lower than the threshold VIL, the noise detection signal FB is dropped from a logic high level to a logic low level to indicate the coupling noise exceeding the tolerance range. In this case, the voltage difference circuit 803 changed the output impedance control signal GB1, so as to increase the output impedances of the second input buffer 802, the first input buffer 321, the first input buffer 322 and/or the first input buffer 323. The voltage difference circuit 803 may perform the aforementioned detection operation in a specific cycle (e.g., including a plurality of horizontal scanning periods, one (or more) frame period(s)). After one specific period ends, the noise detection signal FB is pulled from the logic low level to the logic high level. In the next specific cycle, the voltage difference circuit 803 may perform again the operation of detecting the coupling noise, so as to adaptively increase the output impedances of the second input buffer 802, the first input buffer 321, the first input buffer 322 and/or the first input buffer 323. As several specific cycle go through cyclically until the voltage difference V1'-GND is no longer lower than the threshold VIL, the voltage difference circuit 803 thereby obtains the preferable output impedance.

Figure 10:
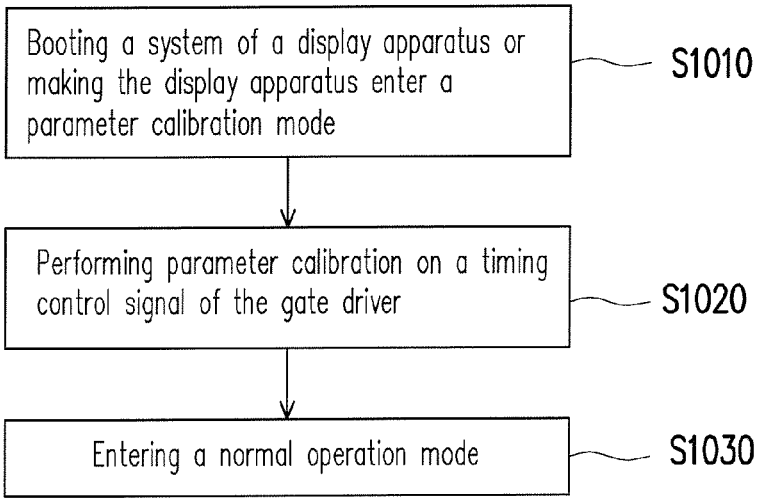
FIG. 10 is a flowchart illustrating an operation method of a display apparatus according to an embodiment of the invention.

FIG. 10 is a flowchart illustrating an operation method of a display apparatus according to an embodiment of the invention. When a system of a display apparatus is boot, or the display apparatus enters a parameter calibration mode based on the system requirement (step S1010), the sensing circuit 325 performs parameter calibration on a timing control signal of the gate driver 320 (step S1020) to correspondingly adjust the output impedances of the first input buffers 321, 322 and/or 323 according to the coupling noise. After step S1020, the sensing circuit 325 obtains the preferable output impedance. After the display apparatus enters a normal operation mode (step S1030), the first input buffers 321, 322 and/or 323 may transmit signal with the output impedance obtained in step S1020.

Figure 11:
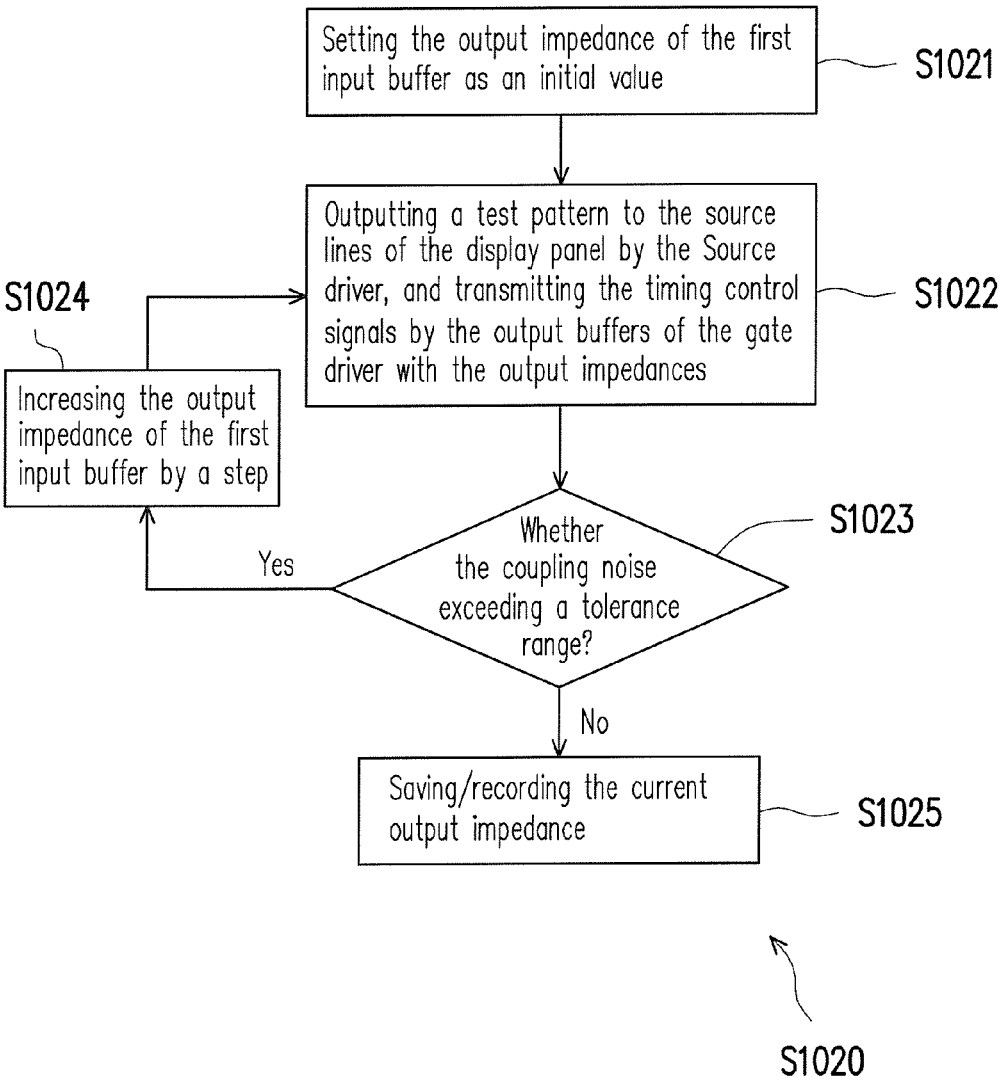
FIG. 11 is a flowchart of step S1020 depicted in FIG. 10 according to an embodiment of the invention.

FIG. 11 is a flowchart of step S1020 depicted in FIG. 10 according to an embodiment of the invention. The parameter calibration (step S1020) performed on the timing control signals of the gate driver includes sub steps S1021 to S1025. In step S1021, parameter values of the output impedances of the first input buffers 321, 322 and/or 323 are set to an initial value. The initial value may be determined based on design requirements, for example, the initial value may be set to a minimum, a maximum, a median or other values within a parameter value range. In step S1022, the source driver 330 outputs a test pattern to the source lines of the display panel 340, and the input buffers 321, 322 and/or 323 of the gate driver 320 receives the timing control signals (e.g., the start pulse signal STV, the gate clock signal GCLK and/or the output enable signal OE) and transmits the timing control signals (e.g., the start pulse signal STV', the gate clock signal GCLK' and/or the output enable signal OE') to the gate line driving circuit 324 with the output impedances. In step S1023, whether the coupling noise exceeds a tolerance range is determined. When the coupling noise exceeds the tolerance range (e.g., the voltage difference V1'-GND is lower than the threshold VIL), the output impedances of the first input buffers 321, 322 and/or 323 are increased by a step (step S1024). After step S1024, steps S1022 and S1023 are again performed. When the coupling noise no longer exceeds the tolerance range, the parameter values of the output impedances are saved/recorded. According to the recorded parameter values, the voltage difference circuit 803 adaptively controls the output impedances of the first input buffers 321, 322 and/or 323 through the output impedance control signal GB1.

For instance, in step S1021, parameter values of the output impedances of the first input buffers 321, 322 and/or 323 are set to "000" (i.e., an initial value). The parameter value "000" of each of the output impedances of the first input buffers 321, 322 and/or 323 indicates that the output impedance (or a turn-on-resistance value Ron of the internal transistor) is greater than the output impedances of other parameter values. In step S1022, the source driver 330 outputs the test pattern to the source lines of the display panel 340 (to generate the coupling noise to the gate driver 320), and the input buffers 321, 322 and/or 323 gate driver 320 receive the timing control signals (e.g., the start pulse signal STV, the gate clock signal GCLK and/or the output enable signal OE) and transmit the timing control signals (e.g., the start pulse signal STV', the gate clock signal GCLK' and/or the output enable signal OE') to the gate line driving circuit 324 with the output impedances corresponding to the parameter value "000". When in step S1023, the coupling noise is determined as exceeding the tolerance range (e.g., the voltage difference V1'-GND is lower than the threshold VIL), the output impedances of the first input buffers 321, 322 and/or 323 are increased by a step (i.e., the parameter value is changed from "000" to "001") in step S1024. The output impedance corresponding to the parameter value "001" is higher than the output impedance corresponding to the parameter value "000".

After step S1024, steps S1022 and S1023 are again performed. In step S1022, the source driver 330 again outputs the test pattern to the source lines of the display panel 340, and the input buffers 321, 322 and/or 323 of the gate driver 320 receive the timing control signals (e.g., the start pulse signal STV, the gate clock signal GCLK and/or the output enable signal OE) and transmit the timing control signals (e.g., the start pulse signal STV', the gate clock signal GCLK' and/or the output enable signal OE') to the gate line driving circuit 324 with the output impedances corresponding to the new parameter value "001". When the coupling noise is determined as no longer exceeding the tolerance range in step S1023, the parameter value (e.g., "001") corresponding to the current output impedance is saved/recorded (step S1025). According to the recorded parameter value "001", the voltage difference circuit 803 adaptively controls the output impedances of the first input buffers 321, 322 and/or 323 through the output impedance control signal GB1. When in step S1023, the coupling noise is determined as exceeding the tolerance range (e.g., the voltage difference V1'-GND is lower than the threshold VIL) again, the parameter value is further changed from "001" to "010" in step S1024.

Figure 12:
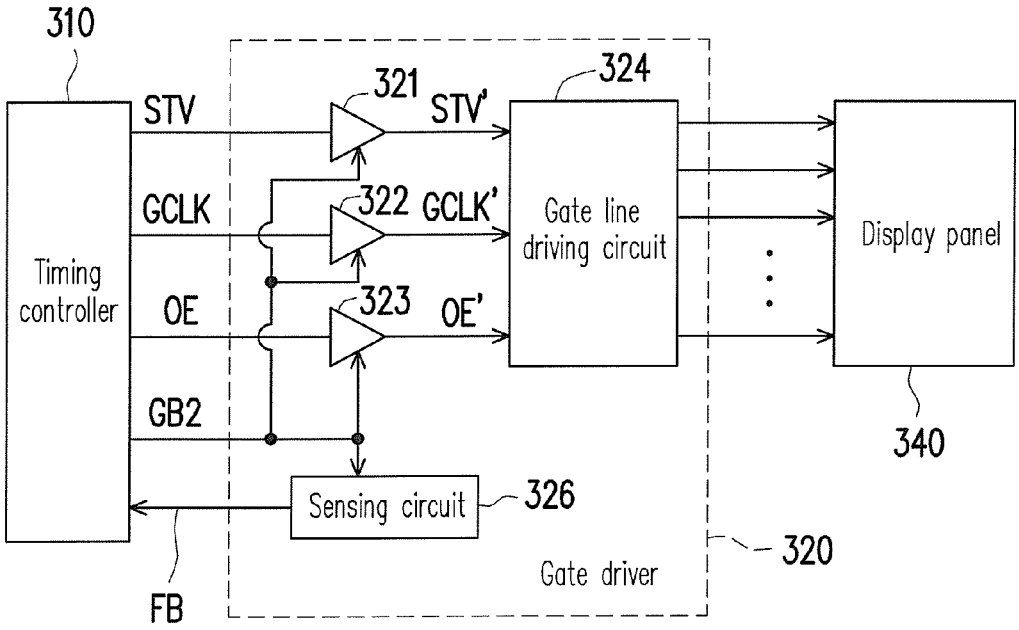
FIG. 12 is a schematic circuit block diagram illustrating the gate driver depicted in FIG. 3 according to another embodiment of the invention.

FIG. 12 is a schematic circuit block diagram illustrating the gate driver 320 depicted in FIG. 3 according to another embodiment of the invention. The gate driver 320 illustrated in FIG. 12 includes one or more first input buffers, including the first input buffers 321, 322 and 323, as illustrated in FIG. 12. The gate driver 320 further includes a gate line driving circuit 324 and a sensing circuit 326. The first input buffer 321, the first input buffer 322, the first input buffer 323, the gate line driving circuit 324 and the sensing circuit 326 may be deduced according to the descriptions relates to the first input buffer 321, the first input buffer 322, the first input buffer 323, the gate line driving circuit 324 and the sensing circuit 325 illustrated in FIG. 4.

Referring to FIG. 12, the sensing circuit 326 senses coupling noise to correspondingly obtain a noise detection signal FB. The sensing circuit 326 returns the noise detection signal FB to the timing controller 310. The operation of the sensing circuit 326 may be deduced according to the description related to embodiment illustrated in FIG. 9 and thus, will not be repeated. The timing controller 310 correspondingly provides an output impedance control signal GB2 to the first input buffers 321, 322 and/or 323 of the gate driver 320 according to the noise detection signal FB to adaptively adjust the output impedances of the first input buffers 321, 322 and/or 323. The operation of the timing controller 310 adjusting the noise detection signal FB may be deduced according to the description related to the embodiments illustrated in FIG. 10 and FIG. 11 and thus, will not be repeated. The output impedance control signal GB2 illustrated in FIG. 12 may be deduced according to the description related to the output impedance control signal GB1 illustrated in FIG. 3.

Figure 13:
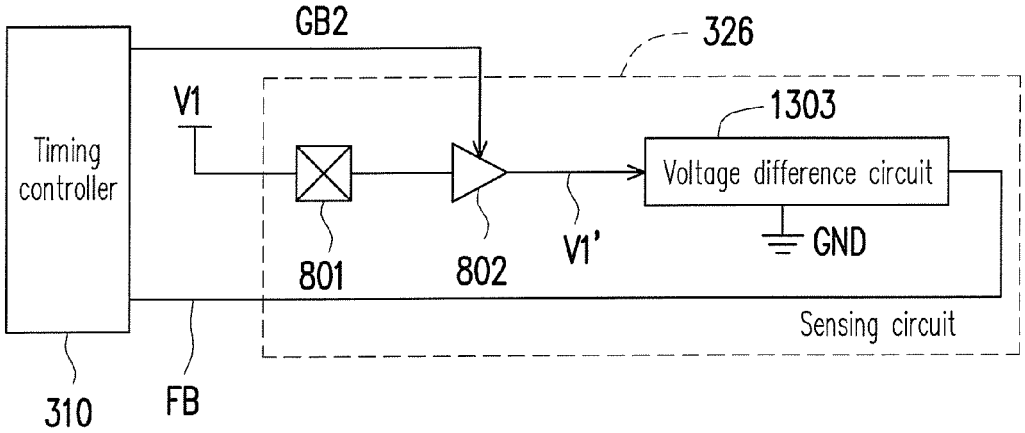
FIG. 13 is a schematic circuit block diagram of the sensing circuit depicted in FIG. 12 according to an embodiment of the invention.

FIG. 13 is a schematic circuit block diagram of the sensing circuit 326 depicted in FIG. 12 according to an embodiment of the invention. The sensing circuit 326 illustrated in FIG. 13 includes a pad 801, a second input buffer 802 and a voltage difference circuit 1303. The pad 801, the second input buffer 802 and the voltage difference circuit 1303 illustrated in FIG. 13 may be deduced according to the descriptions related to the pad 801, the second input buffer 802 and the voltage difference circuit 803 illustrated in FIG. 8 and thus, will not be repeated. A first input terminal of the voltage difference circuit 1303 is coupled to an output terminal of the second input buffer 802 to receive a corresponding voltage V1'. A second input terminal of the voltage difference circuit 1303 is coupled to a second reference voltage (e.g., a ground voltage GND). The voltage difference circuit 1303 detects a voltage difference (i.e., V1'-GND) between the corresponding voltage V1' and the ground voltage GND. The voltage difference circuit 1303 correspondingly determines a noise detection signal FB according to the voltage difference V1'-GND. In some embodiments, the voltage difference circuit 1303 may include a voltage comparator, an error amplifier or other voltage difference circuits. The voltage difference circuit 1303 outputs the noise detection signal FB to the timing controller 310. The timing controller 310 correspondingly provides the output impedance control signal GB2 to the first input buffers 321, 322, 323 and the second input buffer 802 of the gate driver 320 according to the noise detection signal FB to adaptively adjust the output impedances of the first input buffer 321, 322, 323 and the second input buffer 802.

Referring to FIG. 9 and FIG. 13, when the voltage difference circuit 1303 detects that the voltage difference V1'-GND is lower than the threshold VIL, it indicates that the coupling noise exceeds a specific tolerance range, and thus, the voltage difference circuit 1303 determines the current output impedance of the second input buffer 802 (which is the output impedance of each of the first input buffers 321, 322 and/or 323) is not suitable for the current environment. When the voltage difference V1'-GND is lower than the threshold VIL, the voltage difference circuit 1303 drops the noise detection signal FB from a logic high level to a logic low level to indicate that the coupling noise exceeds the tolerance range. In this case, the timing controller 310 correspondingly changes the output impedance control signal GB2, so as to increase the output impedances of the second input buffer 802, the first input buffer 321, the first input buffer 322 and/or the first input buffer 323. The voltage difference circuit 1303 may perform the aforementioned operation of detecting the coupling noise in a specific cycle (e.g., including a plurality of horizontal scanning periods, one (or more) frame period(s)). After one specific period ends, the voltage difference circuit 1303 pulls the noise detection signal FB from the logic low level back to the logic high level. In the next specific cycle, the voltage difference circuit 1303 may perform again the operation of detecting the coupling noise, so as to notify the timing controller 310 to adaptively increase the output impedances of the second input buffer 802, the first input buffer 321, the first input buffer 322 and/or the first input buffer 323. As several specific cycle go through cyclically until the voltage difference V1'-GND is no longer lower than the threshold VIL, the timing controller 310 thereby obtains the preferable output impedance.

Figure 14:
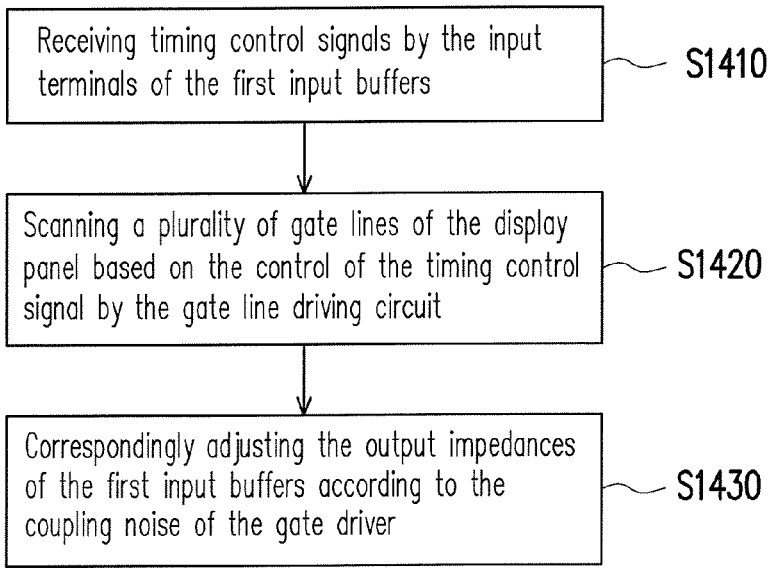
FIG. 14 is a flowchart illustrating an operation method of the gate driver of the display panel according to an embodiment of the invention.

FIG. 14 is a flowchart illustrating an operation method of the gate driver 320 of the display panel 340 according to an embodiment of the invention. In step S1410, the input terminals of the first input buffers 321, 322 and/or 323 receive timing control signals (e.g., the start pulse signal STV, the gate clock signal GCLK and/or the output enable signal OE) from the outside of the gate driver 320. In step S1420, the gate line driving circuit 324 scans a plurality of gate lines G1 to Gn of the display panel 340 based on the control of the timing control signal. In step S1430, the output impedances of the first input buffers 321, 322 and/or 323 are correspondingly adjusted according to the coupling noise of the gate driver 320.

Figure 15:
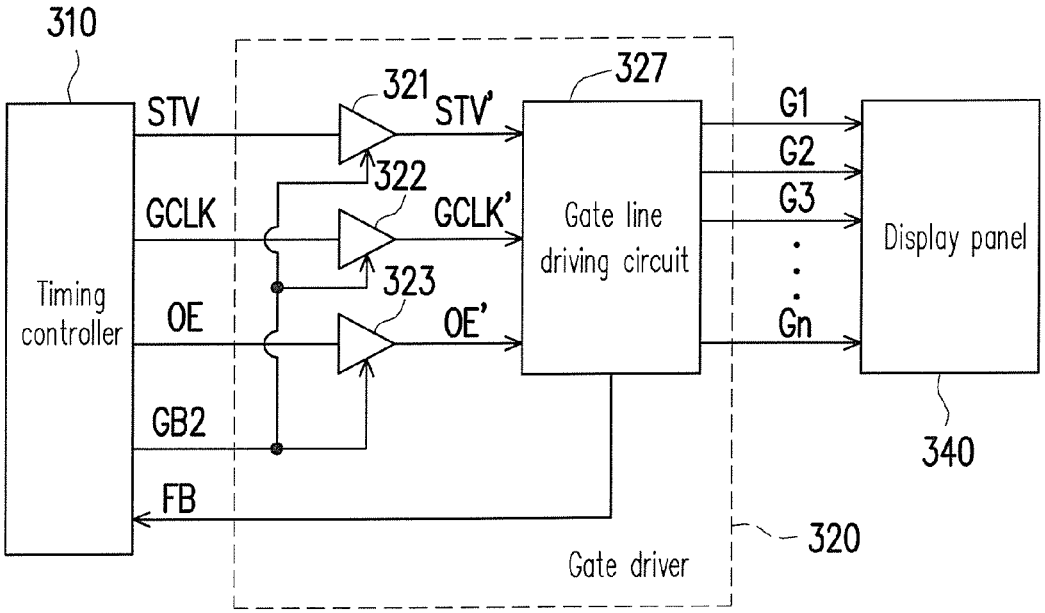
FIG. 15 is a schematic circuit block diagram illustrating the gate driver depicted in FIG. 3 according to yet another embodiment of the invention.

FIG. 15 is a schematic circuit block diagram illustrating the gate driver 320 depicted in FIG. 3 according to yet another embodiment of the invention. The gate driver 320 illustrated in FIG. 15 includes one or more first input buffers, including the first input buffers 321, 322 and 323, as illustrated in FIG. 15. The gate driver 320 further includes a gate line driving circuit 327. The first input buffer 321, the first input buffer 322, the first input buffer 323, the gate line driving circuit 324 and the gate line driving circuit 327 illustrated in FIG. 15 may be deduced according to the descriptions relates to the may be deduced according to the descriptions relates to the first input buffer 321, the first input buffer 322, the first input buffer 323, the gate line driving circuit 324 illustrated in FIG. 4 and thus, will not be repeated.

The gate line driving circuit 327 outputs a noise detection signal FB corresponding to the coupling noise to the timing controller 310. The timing controller 310 correspondingly provides the output impedance control signal GB2 to the first input buffers 321, 322 and/or 323 of the gate driver 320 according to the noise detection signal FB to adjust the output impedances of the first input buffers 321, 322 and/or 323.

In some embodiments, the gate line driving circuit 327 may be triggered by the gate clock signal GCLK' to transmit the start pulse signal STV' in a plurality of gate driving channels of the gate line driving circuit 327. After the start pulse signal STV' is transmitted from the first gate driving channel of the gate line driving circuit 327 to the last gate driving channel of the gate line driving circuit 327, the gate line driving circuit 327 may output the start pulse signal of the last gate driving channel to another gate driver (if any). The start pulse signal of the last gate driving channel of the gate line driving circuit 327 may be returned to the timing controller 310 to serve as the noise detection signal FB.

Figure 16:
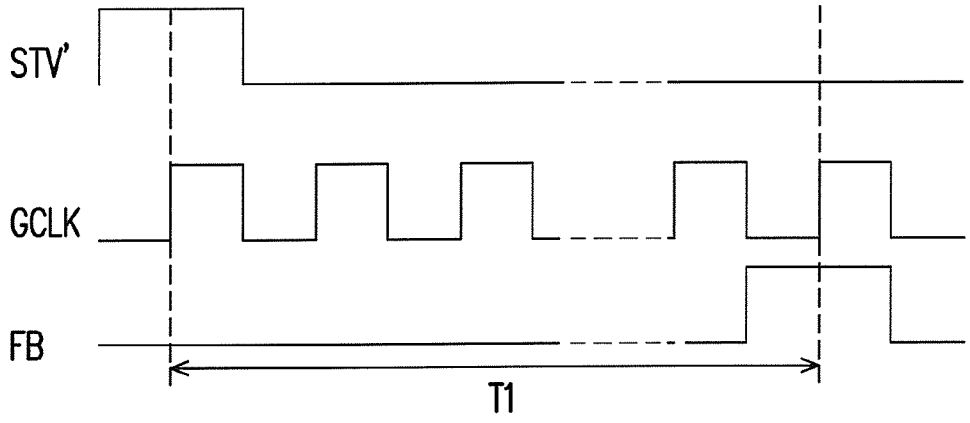
FIG. 16 is a schematic signal timing diagram of the circuit depicted in FIG. 15 according to an embodiment of the invention.

FIG. 16 is a schematic signal timing diagram of the circuit depicted in FIG. 15 according to an embodiment of the invention. In FIG. 16, the horizontal axis represents the time. Based on the trigger of the gate clock signal GCLK', the start pulse signal STV' may be transmitted from the first gate driving channel of the gate line driving circuit 327 to the last gate driving channel of the gate line driving circuit 327. The gate line driving circuit 327 may output the start pulse signal transmitted to the last gate driving channel to serve it as the noise detection signal FB. Since the number of the gate driving channels of the gate line driving circuit 327 is predictable, a time length T1 (e.g., a frame period or horizontal periods in a fixed number) from a pulse of the start pulse signal STV' to a pulse of the noise detection signal FB is also predictable. If the coupling noise exceeds a specific tolerance range, malfunction occurs to the gate line driving circuit 327 due to the coupling noise, such that a phase of the pulse of the noise detection signal FB moves forward (or backward). The timing controller 310 may learn whether the coupling noise causes any occurrence of malfunction to the gate driver 320 by checking the time length T1 from the pulse of the start pulse signal STV to the pulse of the noise detection signal FB.

Figure 17:
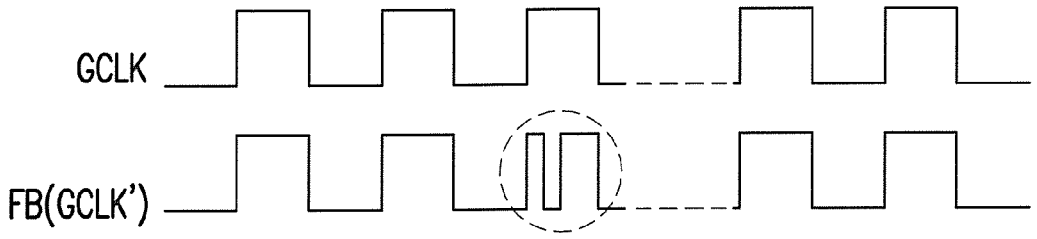
FIG. 17 is a schematic signal timing diagram of the circuit depicted in FIG. 15 according to another embodiment of the invention.

Referring to FIG. 15, the first input buffer 322 receives the gate clock signal GCLK provided by the timing controller 310 and transmits the gate clock signal GCLK' to the gate line driving circuit 327. Thus, in some other embodiments, the gate line driving circuit 327 may returns the gate clock signal GCLK' to the timing controller 310 to serve it as the noise detection signal FB. FIG. 17 is a schematic signal timing diagram of the circuit depicted in FIG. 15 according to another embodiment of the invention. In FIG. 17, the horizontal axis represents the time. If the coupling noise exceeds a specific tolerance range, an error (which is, for example, marked by a dashed circle in FIG. 17) occurs to the gate clock signal GCLK' in the gate driver 320. The timing controller 310 compares the original gate clock signal GCLK with the gate clock signal GCLK' (i.e., the noise detection signal FB) returned by the gate driver 320, and thereby, whether the coupling noise causes malfunction to the gate driver 320 is learned.

Figure 18:
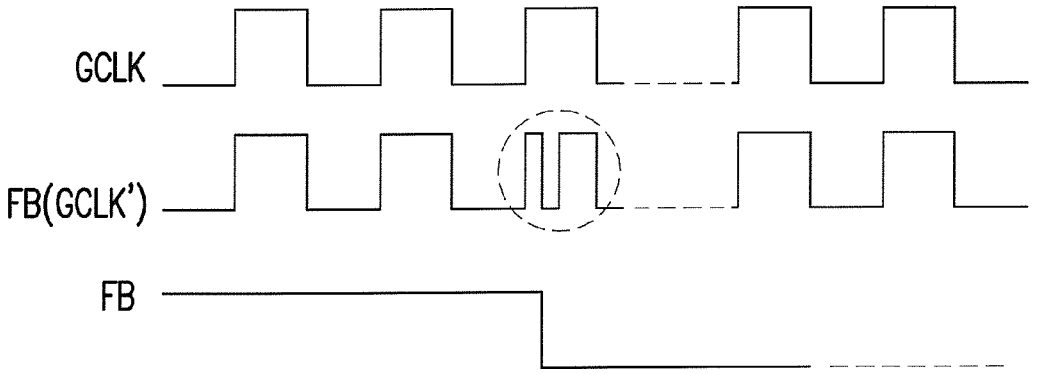
FIG. 18 is a schematic signal timing diagram of the circuit depicted in FIG. 15 according to yet another embodiment of the invention.

In some other embodiments, the gate line driving circuit 327 may compare the original gate clock signal GCLK with the gate clock signal GCLK' of the first input buffer 322 and return the comparison result to the timing controller 310 to serve it as the noise detection signal FB. FIG. 18 is a schematic signal timing diagram of the circuit depicted in FIG. 15 according to yet another embodiment of the invention. In FIG. 18, the horizontal axis represents the time. If the coupling noise exceeds a specific tolerance range, an error (which is, for example, marked by a dashed circle in FIG. 18) occurs to the gate clock signal GCLK' in the gate driver 320. The gate line driving circuit 327 compares the original gate clock signal GCLK with the gate clock signal GCLK' of the first input buffer 322. When the error is about to occur in the gate clock signal GCLK', the noise detection signal FB is dropped from a logic high level to a logic low level to indicate that the coupling noise exceeds the tolerance range. The timing controller 310 then may learn whether the coupling noise causes malfunction to the gate driver 320 according to the noise detection signal FB illustrated in FIG. 18.

Figure 19:
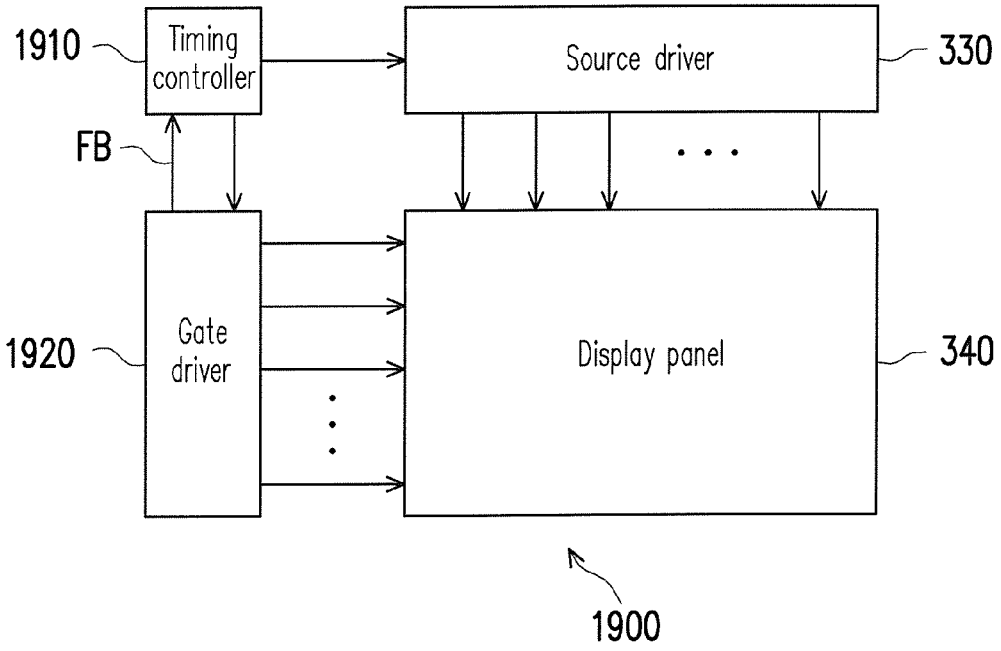
FIG. 19 is a schematic circuit block diagram illustrating a display apparatus according to another embodiment of the invention.

FIG. 19 is a schematic circuit block diagram illustrating a display apparatus 1900 according to another embodiment of the invention. Referring to FIG. 19, the display apparatus 1900 includes a timing controller 1910, a gate driver 1920, a source driver 330 and a display panel 340. The timing controller 1910, the gate driver 1920, the source driver 330 and the display panel 340 illustrated in FIG. 19 may be deduced according to the descriptions related to the timing controller 310, the gate driver 320, the source driver 330 and the display panel 340 illustrated in FIG. 3.

Figure 20:
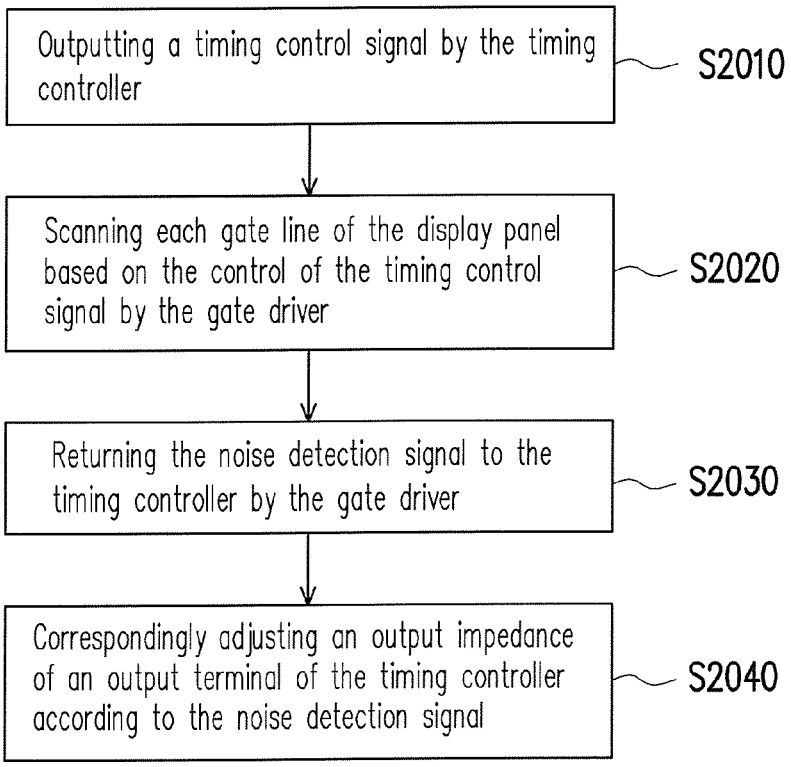
FIG. 20 is a flowchart illustrating an operation method of the display apparatus according to another embodiment of the invention.

FIG. 20 is a flowchart illustrating an operation method of the display apparatus 1900 according to another embodiment of the invention. Referring to FIG. 19 and FIG. 20, The timing controller 1910 outputs a timing control signal (e.g., the start pulse signal STV, the gate clock signal GCLK and/or the output enable signal OE) to the gate driver 1920 in step S2010. A plurality of output terminals of the gate driver 1920 are one-to-one coupled to different gate lines of the display panel 340. In step S2020, the gate driver 1920 receives the timing control signal and scans each gate line of the display panel 340 based on the control of the timing control signal. In step S2030, the gate driver 1920 returns the noise detection signal FB corresponding to the coupling noise to the timing controller 1910. In some embodiments, the description of the gate driver 1920 may be reduced with reference to the description related to the gate driver 320 illustrated in FIG. 12. In step S2040, the timing controller 310 correspondingly adjusts an output impedance of an output terminal of the timing controller 1910 according to the noise detection signal FB.

Figure 21:
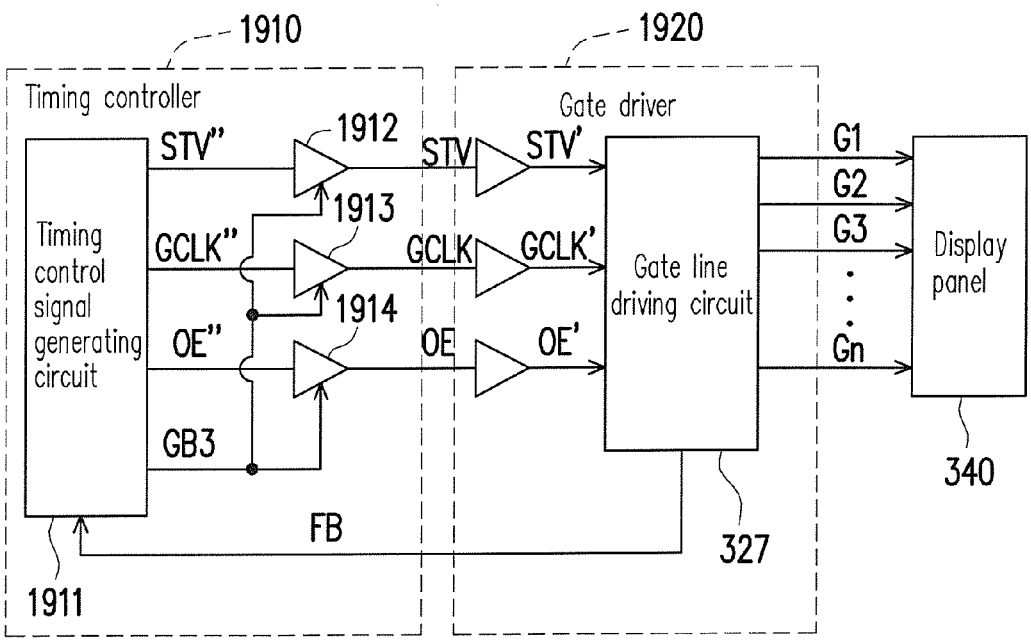
FIG. 21 is a schematic circuit block diagram of the timing controller and the gate driver depicted in FIG. 19 according to an embodiment of the invention.

FIG. 21 is a schematic circuit block diagram of the timing controller 1910 and the gate driver 1920 depicted in FIG. 19 according to an embodiment of the invention. In the embodiment illustrated in FIG. 21, the gate driver 1920 includes a gate line driving circuit 327. The gate line driving circuit 327 outputs the noise detection signal FB corresponding to the coupling noise to the timing controller 1910. The timing controller 1910 correspondingly adjusts the output impedance of the output terminal of the timing controller 1910 according to the noise detection signal FB. The description of gate line driving circuit 327 and the noise detection signal illustrated in FB FIG. 21 may be reduced with reference to the descriptions related to the embodiments illustrated in FIG. 15 to FIG. 18 and thus, will not be repeated.

In the embodiment illustrated in FIG. 21, the timing controller 1910 includes a timing control signal generating circuit 1911, an output buffer 1912, an output buffer 1913 and an output buffer 1914. The timing control signal generating circuit 1911 generates a timing control signal (e.g., the start pulse signal STV", the gate clock signal GCLK" and/or the output enable signal OE"). Input terminals of the output buffers 1912, 1913 and/or 1914 are coupled to the timing control signal generating circuit 1911 to receive the timing control signal (e.g., the start pulse signal STV", the gate clock signal GCLK" and/or the output enable signal OE"). Output terminals of the output buffers 1912, 1913 and/or 1914 are coupled to the gate driver 1920 to provide the timing control signal (e.g., the start pulse signal STV, the gate clock signal GCLK and/or the output enable signal OE). The timing control signal generating circuit 1911 is coupled to the gate line driving circuit 327 of the gate driver 1920 to receive the noise detection signal FB. The timing control signal generating circuit 1911 correspondingly generates an output impedance control signal GB3 to the output buffers 1912, 1913 and/or 1914 according to the noise detection signal FB to adjust output impedances of the output buffers 1912, 1913 and/or 1914. The output buffers 1912, 1913 and/or 1914 illustrated in FIG. 21 may be deduced with reference to the description related to the first input buffers 321, 322 and/or 323 illustrated in FIG. 4 and thus, will not be repeated.

The embodiment illustrated in FIG. 21 may also be deduced with reference to the description related to the embodiment illustrated in FIG. 6. Based on the control of the output impedance control signal GB3 of the timing control signal generating circuit 1911, when the output impedances of the output buffers 1912, 1913 and/or 1914 are increased (i.e., the thrusting/driving capabilities are reduced), intensities (or amplitudes) of noise 501', noise 502' and noise 503' in the gate clock signal GCLK' are increased due to the coupling noise. When the intensities (or the amplitudes) of the coupling noise 501', noise 502' and noise 503' of the gate clock signal GCLK' are close (even equal) to intensities (or the amplitudes) of the coupling noise 511, noise 512 and noise 513 of the ground voltage GND, the noise intensity (or the amplitude) of the voltage difference GCLK'-GND are reduced. When the intensity (the amplitude) of the coupling noise of the voltage difference GCLK'-GND is within the tolerance range, the coupling noise does not cause malfunction to the gate driver 1920. Thus, the gate line driving circuit 327 may output a scan signal with an accurate phase and an accurate pulse width to the gate lines G1 and G2.

Figure 22:
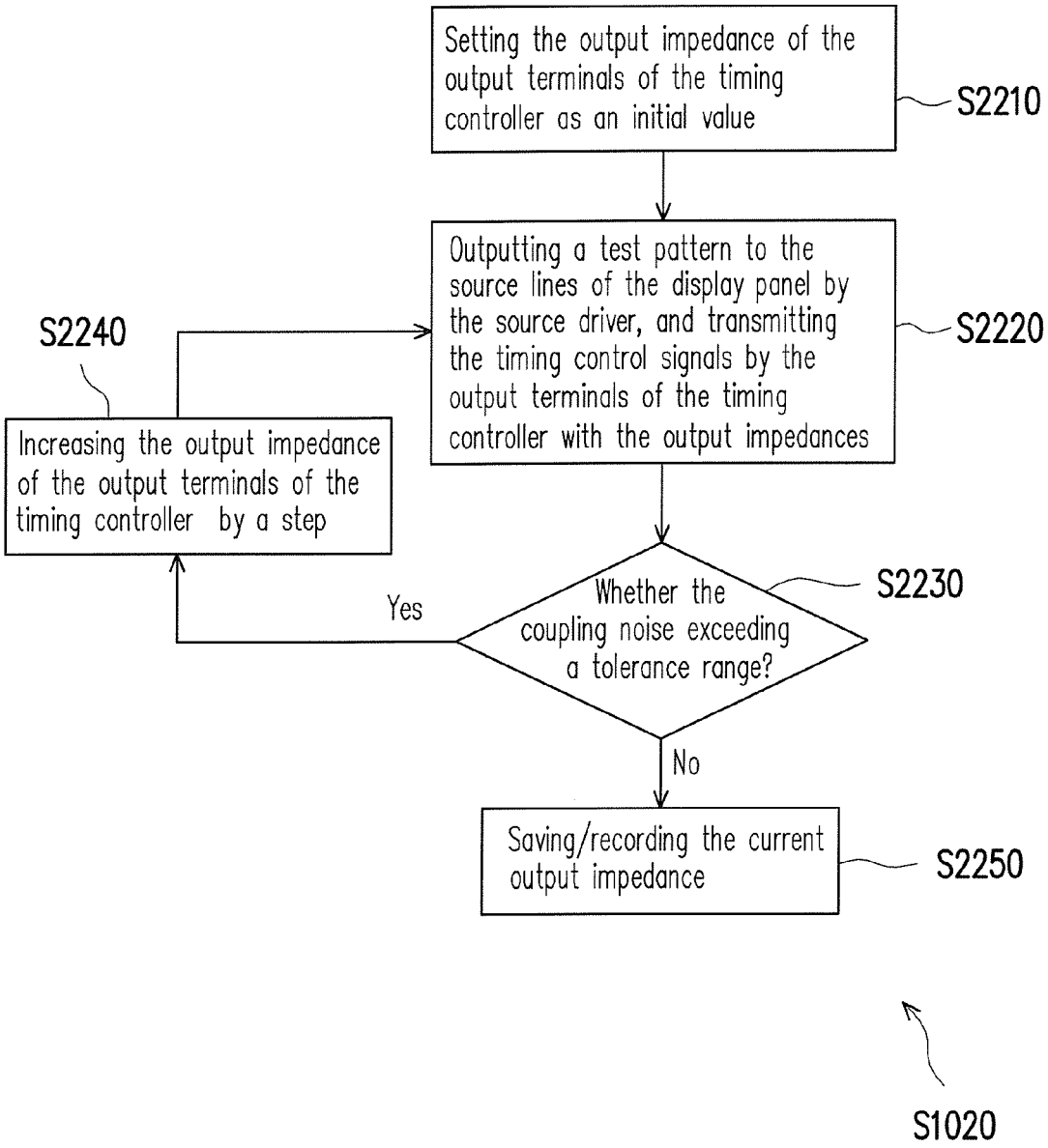
FIG. 22 is a flowchart of step S1020 depicted in FIG. 10 according to another embodiment of the invention.

When the system is boot or enters a parameter calibration mode, the timing controller 1910 performs parameter calibration on the timing control signal of the gate driver 1920 to correspondingly adjust the output impedances of the output terminals of the timing controller 1910 according to the coupling noise. FIG. 22 is a flowchart of step S1020 depicted in FIG. 10 according to another embodiment of the invention. Steps S1020 illustrated in FIG. 22 includes sub steps S2210, S2220, S2230, S2240 and S2250. In step S2210, parameter values of the output impedances of the output terminals of the timing controller 1910 (i.e., the output impedances of the output buffers 1912, 1913 and/or 1914) are set to an initial value. The initial value may be determined based on design requirements, for example, the initial value may be set to a minimum, a maximum, a median or other values within a parameter value range. In step S2220, the source driver 330 outputs a test pattern to the source lines of the display panel 340, and the output buffers 1912, 1913 and/or 1914 of the timing controller 1910 receive the timing control signals (e.g., the start pulse signal STV", the gate clock signal GCLK" and/or the output enable signal OE") from the timing control signal generating circuit 1911 and transmit the timing control signals (e.g., the start pulse signal STV, the gate clock signal GCLK and/or the output enable signal OE) to the gate driver 1920 with the output impedances. In step S2230, whether the coupling noise exceeds a tolerance range is determined according to the noise detection signal FB. When the coupling noise exceeds the tolerance range, one of the output impedances of the output buffers 1912, 1913 and/or 1914 (e.g., the output impedance of the output terminal of the timing controller 1910) is increased for a step (step S2240). After step S2240, steps S2220 and S2230 are again performed. When the coupling noise no longer exceed that the tolerance range, the parameter values of the current output impedances are saved/recorded (step S2250). According to the recorded parameter values, the timing control signal generating circuit 1911 adaptively controls the output impedances of the output buffers 1912, 1913 and/or 1914 through the output impedance control signal GB3.

For instance, in step S2210, parameter values of the output impedances of the output buffers 1912, 1913 and/or 1914 are set to "000" (i.e., an initial value). The parameter value "000" indicates that the output impedance (or a turn-on-resistance value Ron of the internal transistor) is greater than the output impedances of other parameter values. In step S2220, the source driver 330 outputs the test pattern to the source lines of the display panel 340 (to generate the coupling noise to the gate driver 1920), and the output buffers 1912, 1913 and/or 1914 of the timing controller 1910 receive the timing control signals (e.g., the start pulse signal STV", the gate clock signal GCLK" and/or the output enable signal OE") from the timing control signal generating circuit 1911 and transmit the timing control signals (e.g., the start pulse signal STV, the gate clock signal GCLK and/or the output enable signal OE) to the gate driver 1920 with the output impedances corresponding to the parameter value "000". When in step S2230, the coupling noise is determined as exceeding the tolerance range, the output impedances of the output buffers 1912, 1913 and/or 1914 are increased by a step (i.e., the parameter value is changed from "000" to "001") in step S2240. The output impedance corresponding to the parameter value "001" is higher than the output impedance corresponding to the parameter value "000". After step S2240, steps S2220 and S2230 are again performed. In step S2220, the source driver 330 again outputs the test pattern to the source lines of the display panel 340, and the output buffers 1912, 1913 and/or 1914 of the timing controller 1910 transmit the timing control signals to the gate driver 1920 with the output impedances corresponding to the new parameter value "001". When in step S2230, the coupling noise is determined as no longer exceeding the tolerance range, the parameter value (e.g., "001") corresponding to the current output impedance is saved/recorded. According to the recorded parameter value "001", the timing control signal generating circuit 1911 adaptively controls the output impedances of the output buffers 1912, 1913 and/or 1914 through the output impedance control signal GB3. When in step S2230, the coupling noise is determined as exceeding the tolerance range, the parameter value is further changed from "001" to "010" in step S2240.

Figure 23:
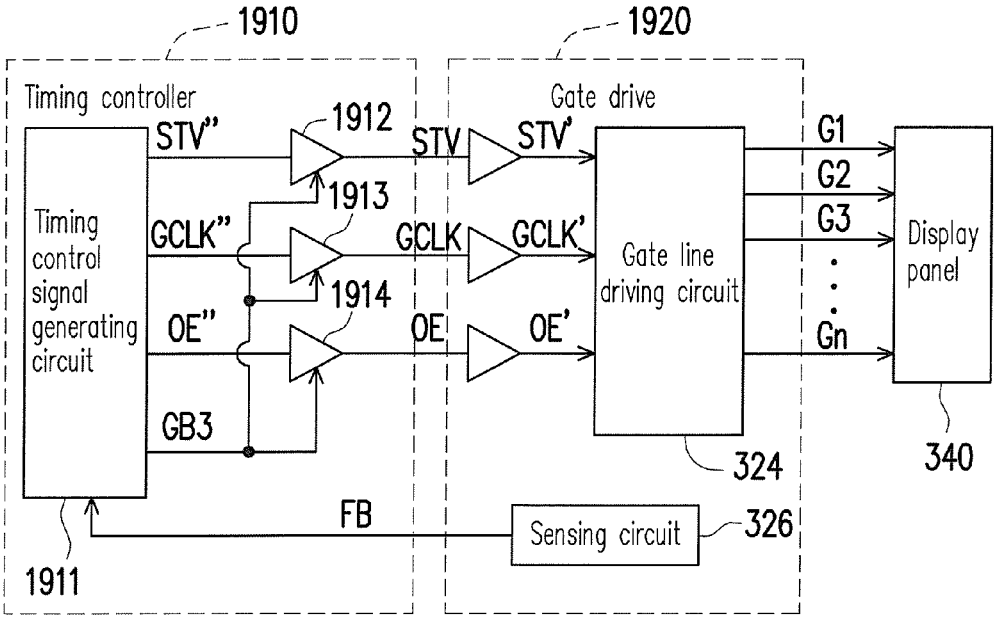
FIG. 23 is a schematic circuit block diagram of the timing controller and the gate driver depicted in FIG. 19 according to another embodiment of the invention.

FIG. 23 is a schematic circuit block diagram of the timing controller 1910 and the gate driver 1920 depicted in FIG. 19 according to another embodiment of the invention. The gate driver 1920 illustrated in FIG. 23 includes a gate line driving circuit 324 and a sensing circuit 326. The sensing circuit 326 senses the coupling noise of the gate driver 1920 and outputs the noise detection signal FB corresponding to the coupling noise to the timing controller 1910 according to the coupling noise. The gate line driving circuit 324 and the sensing circuit 326 illustrated in FIG. 23 may be deduced with reference to the descriptions related to the gate line driving circuit 324 and the sensing circuit 326 illustrated in FIG. 12 and FIG. 13 and thus, will not be repeated. The timing controller 1910 illustrated in FIG. 23 may be deduced with reference to the description related to the timing controller 1910 illustrated in FIG. 21 and thus, will not be repeated.

Figure 24:
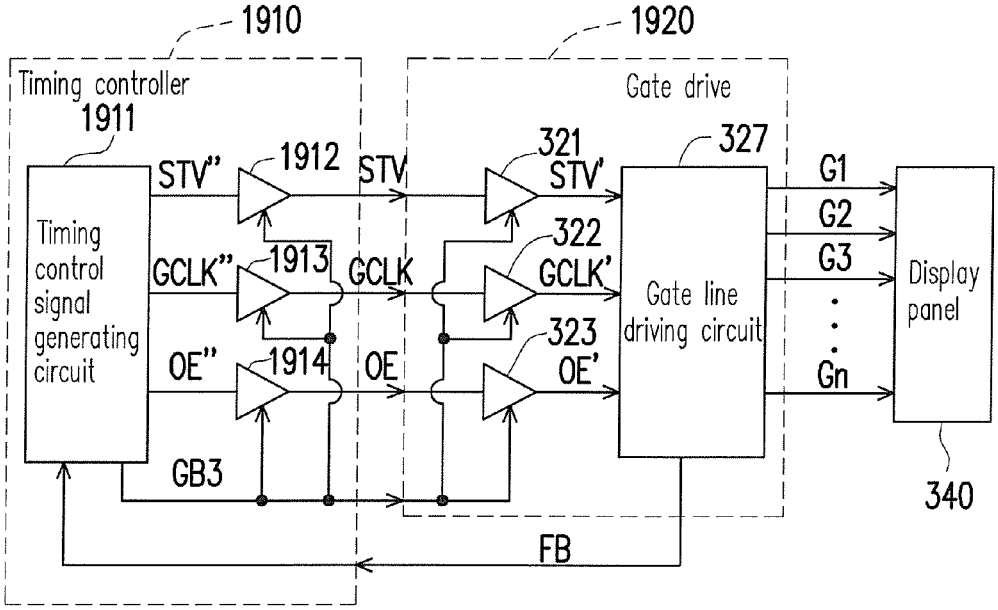
FIG. 24 is a schematic circuit block diagram of the timing controller and the gate driver depicted in FIG. 19 according to yet another embodiment of the invention.

FIG. 24 is a schematic circuit block diagram of the timing controller 1910 and the gate driver 1920 depicted in FIG. 19 according to yet another embodiment of the invention. In the embodiment illustrated in FIG. 24, the gate driver 1920 includes a first input buffer 321, a first input buffer 322, a first input buffer 323 and a gate line driving circuit 327. The gate line driving circuit 327 outputs the noise detection signal FB corresponding to the coupling noise to the timing controller 1910. The first input buffer 321, the first input buffer 322, the first input buffer 323, the gate line driving circuit 327 and the noise detection signal FB illustrated in FIG. 24 may be deduced with reference to the descriptions related to the embodiments illustrated in FIG. 15 to FIG. 18 and thus, will not be repeated.

The timing controller 1910 correspondingly adjusts the output impedances of the output terminals of the timing controller 1910. The timing controller 1910 illustrated in FIG. 24 may be deduced with reference to the description related to the timing controller 1910 illustrated in FIG. 21 and thus, will not be repeated. In the embodiment illustrated in FIG. 24, the timing control signal generating circuit 1911 further outputs the output impedance control signal GB3 to the first input buffers 321, 322 and/or 323 of the gate driver 1910 to adaptively adjust the output impedances of the first input buffers 321, 322 and/or 323.

In light of the foregoing, the display apparatus, the gate driver and the operation method thereof provided by the embodiments of the invention can detect the coupling noise of the gate driver. In some embodiments, the output impedances of the input buffers of the gate driver can be correspondingly adjusted according to the coupling noise. In some other embodiments, the output impedances of the output terminal of the timing controller can be correspondingly adjusted according to the coupling noise of the gate driver. When the output impedances are increased (i.e., the thrusting/driving capabilities are reduced), the intensities (or the amplitudes) of the pulses of the noise in the timing control signal caused by the coupling noise are increased. When the intensities (or the amplitudes) of the coupling noise of the timing control signal are close (even equal) to the intensities (or the amplitudes) of the coupling noise of the ground voltage GND, the intensity (or the amplitude) of the voltage difference between the timing control signal and the ground voltage GND can be reduced. Thereby, the embodiments of the invention can contribute to avoiding the malfunction caused by the coupling noise.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. A gate driver of a display panel, comprising:

a sensing circuit, configured to sense a coupling noise of the gate driver;

a first input buffer, having an input terminal configured to receive a timing control signal from the outside of the gate driver, wherein an output impedance of an output terminal of the first input buffer is correspondingly adjusted according to the coupling noise of the gate driver; and a gate line driving circuit, coupled to the output terminal of the first input buffer and configured to scan a plurality of gate lines of the display panel based on the control of the timing control signal.

2. The gate driver according to claim 1, wherein when a system is boot or enters a parameter calibration mode, the sensing circuit performs parameter calibration on the timing control signal of the gate driver to correspondingly adjust the output impedance of the first input buffer according to the coupling noise.

3. The gate driver according to claim 2, wherein the operation of performing the parameter calibration on the timing control signal of the gate driver comprises:

setting the output impedance of the first input buffer as an initial value;

transmitting the timing control signal to the gate line driving circuit by the first input buffer with the output impedance; and when the coupling noise exceeds a tolerance range, increasing the output impedance of the first input buffer by a step.

4. The gate driver according to claim 1, wherein the sensing circuit correspondingly outputs an output impedance control signal to the first input buffer according to the coupling noise to adjust the output impedance of the first input buffer, and the first input buffer comprises:

a plurality of buffer circuits, having input terminals coupled to the input terminal of the first input buffer, output terminals coupled to the output terminal of the first input buffer and enable terminals coupled to a plurality of bits of the output impedance control signal in a one-to-one manner.

5. The gate driver according to claim 1, wherein the sensing circuit correspondingly outputs an output impedance control signal to the first input buffer according to the coupling noise to adjust the output impedance of the first input buffer, and the sensing circuit comprises:

a pad, configured to receive a first reference voltage;

a second input buffer, having an input terminal coupled to the pad to receive the first reference voltage, and an output terminal outputting a corresponding voltage; and a voltage difference circuit, having a first input terminal coupled to the output terminal of the second input buffer to receive the corresponding voltage, and a second input terminal coupled to a second reference voltage, wherein the voltage difference circuit is configured to detect a voltage difference between the corresponding voltage and the second reference voltage, correspondingly determines the output impedance control signal according to the voltage difference, and outputs the output impedance control signal to the second input buffer to adjust the output impedance of the second input buffer.

6. The gate driver according to claim 1, wherein the sensing circuit senses the coupling noise to correspondingly obtain a noise detection signal and returns the noise detection signal to a timing controller, and the timing controller correspondingly outputs an output impedance control signal to the first input buffer of the gate driver according to the noise detection signal to adjust the output impedance of the first input buffer.

7. The gate driver according to claim 6, wherein the sensing circuit comprises:

a pad, configured to receive a first reference voltage;

a second input buffer, having an input terminal coupled to the pad to receive the first reference voltage, and an output terminal outputting a corresponding voltage; and a voltage difference circuit, having a first input terminal coupled to the output terminal of the second input buffer to receive the corresponding voltage, and a second input terminal coupled to a second reference voltage, wherein the voltage difference circuit is configured to detect a voltage difference between the corresponding voltage and the second reference voltage, correspondingly determines the noise detection signal according to the voltage difference, and outputs the noise detection signal to the timing controller.

8. The gate driver according to claim 1, wherein the gate line driving circuit is used as the sensing circuit, the gate line driving circuit outputs a noise detection signal corresponding to the coupling noise to a timing controller, and the timing controller correspondingly outputs an output impedance control signal to the first input buffer of the gate driver according to the noise detection signal to adjust the output impedance of the first input buffer.

9. The gate driver according to claim 8, wherein the gate line driving circuit returns a start pulse signal or a gate clock signal to the timing controller to serve as the noise detection signal.

10. An operation method of a gate driver of a display panel, the gate driver having a first input buffer, the method comprising:

sensing a coupling noise of the gate driver;

receiving a timing control signal from the outside of the gate driver;

scanning a plurality of gate lines of the display panel based on the control of the timing control signal; and correspondingly adjusting an output impedance of the first input buffer according to the coupling noise of the gate driver.

11. The operation method of the gate driver according to claim 10, further comprising:

performing parameter calibration on the timing control signal of the gate driver to correspondingly adjust the output impedance of the first input buffer according to the coupling noise by the sensing circuit when a system is boot or enters a parameter calibration mode.

12. The operation method of the gate driver according to claim 10, further comprising:

correspondingly outputting an output impedance control signal to the first input buffer to adjust the output impedance of the first input buffer according to the coupling noise by the sensing circuit.

13. The operation method of the gate driver according to claim 12, further comprising:

receiving a first reference voltage through a pad by an input terminal of a second input buffer, and outputting a corresponding voltage by an output terminal of the second input buffer;

detecting a voltage difference between the corresponding voltage and a second reference voltage by a voltage difference circuit;

correspondingly determining the output impedance control signal according to the voltage difference by the voltage difference circuit; and outputting the output impedance control signal to the second input buffer to adjust the output impedance of the second input buffer by the voltage difference circuit.

14. The operation method of the gate driver according to claim 10, further comprising:

sensing the coupling noise to correspondingly obtain a noise detection signal by the sensing circuit; and returning the noise detection signal to a timing controller by the sensing circuit, wherein an output impedance control signal is correspondingly output to the first input buffer of the gate driver according to the noise detection signal by the timing controller to adjust the output impedance of the first input buffer.

15. An operation method of a display apparatus, the display apparatus having a timing controller and a gate driver, the operation method comprising:

outputting a timing control signal by an output terminal of the timing controller;

receiving the timing control signal and scanning a plurality of gate lines of a display panel by the gate driver based on the control of the timing control signal;

sensing a coupling noise of the gate driver;

returning a noise detection signal corresponding to the coupling noise of the gate driver to the timing controller by the gate driver; and correspondingly adjusting the output impedance of the output terminal of the timing controller according to the noise detection signal.

16. The operation method of the display apparatus according to claim 15, further comprises:

performing parameter calibration on the timing control signal of the gate driver to correspondingly adjust the output impedance of the output terminal of the timing controller by the timing controller according to the coupling noise of the gate driver when a system is boot or enters a parameter calibration mode.

17. The operation method of the display apparatus according to claim 16, wherein the step of performing the parameter calibration on the timing control signal of the gate driver comprises:

setting the output impedance of the output terminal of the timing controller as an initial value;

transmitting the timing control signal to the gate driver by the output terminal of the timing controller with the output impedance; and increasing the output impedance of the output terminal of the timing controller by a step when the coupling noise exceeds a tolerance range.

18. The operation method of the display apparatus according to claim 15, further comprising:

generating the timing control signal by a timing control signal generating circuit of the timing controller;

receiving the timing control signal by an input terminal of an output buffer of the timing controller, and providing the timing control signal to the gate driver by an output terminal of the output buffer;

receiving the noise detection signal of the gate driver by the timing control signal generating circuit; and correspondingly outputting an output impedance control signal to the output buffer according to the noise detection signal by the timing control signal generating circuit to adjust output impedance of the output buffer.

19. The operation method of the display apparatus according to claim 18, further comprising:

receiving the timing control signal of the timing controller by an input terminal of a first input buffer of the gate driver, wherein an output terminal of the first input buffer is coupled to a gate line driving circuit of the gate driver;

scanning the plurality of gate lines of the display panel based on the control of the timing control signal by the gate line driving circuit; and outputting the output impedance control signal to the first input buffer of the gate driver to adjust the output impedance of the first input buffer by the timing control signal generating circuit.

20. The operation method of the display apparatus according to claim 15, further comprising:

receiving the timing control signal of the timing controller by an input terminal of a first input buffer of the gate driver, wherein an output terminal of the first input buffer is coupled to a gate line driving circuit of the gate driver;

scanning the plurality of gate lines of the display panel by the gate line driving circuit based on the control of the timing control signal;

sensing the coupling noise of the gate driver by a sensing circuit of the gate driver; and outputting the noise detection signal corresponding to the coupling noise to the timing controller according to the coupling noise by the sensing circuit.

* * * * *